US010332498B2

(12) United States Patent
McMillen et al.

(10) Patent No.: US 10,332,498 B2
(45) Date of Patent: Jun. 25, 2019

(54) FRET SCANNERS AND PICKUPS FOR STRINGED INSTRUMENTS

(71) Applicant: Kesumo, LLC, Berkeley, CA (US)

(72) Inventors: Keith A. McMillen, Berkeley, CA (US); Chris Shaver, Berkeley, CA (US); Michael Rush, Berkeley, CA (US); Evan Adams, Berkeley, CA (US); Brian Wright, Oakland, CA (US)

(73) Assignee: KMI Music, Inc., Berkeley, CA (US)

( * ) Notice: Subject to any disclaimer, the term of this patent is extended or adjusted under 35 U.S.C. 154(b) by 0 days.

(21) Appl. No.: 15/844,269

(22) Filed: Mar. 12, 2018

(65) Prior Publication Data

US 2018/0174562 A1 Jun. 21, 2018

Related U.S. Application Data

(63) Continuation of application No. 15/448,471, filed on Mar. 2, 2017, now Pat. No. 9,881,598, which is a continuation of application No. 15/296,979, filed on Oct. 18, 2016, now Pat. No. 9,626,947.

(60) Provisional application No. 62/244,590, filed on Oct. 21, 2015.

(51) Int. Cl.

| | |
|---|---|
| ***G10H 3/18*** | (2006.01) |
| ***G10H 1/02*** | (2006.01) |
| ***G10H 1/18*** | (2006.01) |
| ***G10H 1/14*** | (2006.01) |
| ***G10H 3/14*** | (2006.01) |
| ***G10H 3/12*** | (2006.01) |

(52) U.S. Cl.

CPC ..... *G10H 3/18* (2013.01); *G10H 1/02* (2013.01); *G10H 1/14* (2013.01); *G10H 1/18* (2013.01); *G10H 1/182* (2013.01); *G10H 3/125* (2013.01); *G10H 3/143* (2013.01); *G10H 3/185* (2013.01); *G10H 2210/066* (2013.01); *G10H 2220/171* (2013.01); *G10H 2220/301* (2013.01)

(58) Field of Classification Search

CPC G10H 3/18; G10H 3/143; G10H 1/14; G10H 2210/066; G10H 2220/171; G10H 2220/17

USPC ..... 84/616, 725

See application file for complete search history.

(56) References Cited

U.S. PATENT DOCUMENTS 4,295,402 A * 10/1981 Deutsch ..... G10H 1/38 84/650
4,372,187 A * 2/1983 Berg ..... G10H 1/342 84/702
4,468,997 A 9/1984 Young, Jr.
(Continued)

FOREIGN PATENT DOCUMENTS

EP 1277199 4/2014

OTHER PUBLICATIONS

Sitti, et al., "Development of PZT and PZN-PT Based Unimorph Actuators for Micromechanical Flapping Mechanisms," Dept. of EECS, University of California,2001, 8 pages.
(Continued)

*Primary Examiner* — David S Warren
(74) *Attorney, Agent, or Firm* — Weaver Austin Villeneuve & Sampson LLP

(57) ABSTRACT

Techniques are described that relate to various aspects of converting the mechanical energy of instrument strings to digital representations for use in a variety of applications.

16 Claims, 18 Drawing Sheets

(56) References Cited

U.S. PATENT DOCUMENTS 4,630,520 A * 12/1986 Bonanno ..... G10H 1/342 84/647
4,653,376 A * 3/1987 Allured ..... G10H 1/342 84/646
4,658,690 A * 4/1987 Aitken ..... G10H 1/342 84/267
4,676,134 A * 6/1987 Newell ..... G10H 3/18 84/673
4,690,026 A * 9/1987 McCoy ..... G10H 3/125 84/603
4,702,141 A * 10/1987 Bonanno ..... G10H 1/342 84/626
4,726,275 A * 2/1988 Aitken ..... G10H 1/342 84/723
4,730,530 A * 3/1988 Bonanno ..... G10H 3/18 84/724
4,748,887 A * 6/1988 Marshall ..... G10H 1/0066 84/645
4,760,767 A * 8/1988 Tsurubuchi ..... G10H 1/342 84/646
4,823,667 A * 4/1989 Deutsch ..... G10H 1/0066 84/736
4,858,509 A * 8/1989 Marshall ..... G10H 1/0066 84/646
4,911,053 A * 3/1990 Kashio ..... G10H 1/0555 84/725
4,928,563 A * 5/1990 Murata ..... G10G 7/02 324/76.48
4,951,545 A * 8/1990 Yoshida ..... G10H 1/342 84/646
4,951,546 A * 8/1990 Takabayashi ..... G10H 3/18 84/701
4,966,052 A * 10/1990 Shiraki ..... G10H 1/342 84/715
4,974,486 A * 12/1990 Wallace ..... G10H 1/342 446/408
4,991,488 A * 2/1991 Fala ..... G10H 1/0066 84/731
5,005,461 A * 4/1991 Murata ..... G10H 1/0016 84/470 R
5,010,800 A * 4/1991 Yoshida ..... G10D 3/06 84/646
5,024,134 A * 6/1991 Uchiyama ..... G10H 1/342 84/654
5,025,703 A * 6/1991 Iba ..... G10H 1/0091 84/678
5,033,353 A * 7/1991 Fala ..... G10H 1/0066 84/72
5,040,447 A * 8/1991 Murata ..... G09B 15/003 84/477 R
5,065,659 A * 11/1991 Uchiyama ..... G10H 1/342 84/723
5,085,119 A 2/1992 Cole
5,095,799 A * 3/1992 Wallace ..... G10H 1/342 446/408
5,140,887 A * 8/1992 Chapman ..... G10H 1/342 84/314 R
5,153,364 A * 10/1992 Uchiyama ..... G10H 1/342 200/5 A
5,223,659 A 6/1993 Shiraki et al.
5,557,057 A 9/1996 Starr
5,717,155 A * 2/1998 Szalay ..... G10H 3/125 84/723
5,739,455 A 4/1998 Poon
5,777,251 A 7/1998 Hotta
6,166,313 A * 12/2000 Miyamoto ..... G09B 15/04 84/477 R
6,169,240 B1 * 1/2001 Suzuki ..... G10H 7/008 704/503
6,191,350 B1 * 2/2001 Okulov ..... G10H 1/0008 84/646
6,846,980 B2 1/2005 Okulov
7,598,449 B2 10/2009 Sullivan
8,003,877 B2 8/2011 Elion
8,022,288 B2 9/2011 Sullivan
8,084,678 B2 12/2011 McMillen et al.
8,093,482 B1 1/2012 Kramer et al.
8,143,509 B1 * 3/2012 Robertson ..... G10H 3/186 84/604
8,242,345 B2 8/2012 Elion
8,581,086 B2 11/2013 McMillen et al.
8,748,724 B1 * 6/2014 Harmon ..... G10H 1/02 84/737
9,040,804 B2 5/2015 Dejima
9,183,823 B2 11/2015 McMillen
9,626,947 B1 * 4/2017 McMillen ..... G10H 3/18
9,881,598 B2 * 1/2018 McMillen ..... G10H 3/18
2002/0148346 A1 * 10/2002 Okulov ..... G10H 1/342 84/613
2004/0187673 A1 * 9/2004 Stevenson ..... G10H 1/02 84/737
2007/0191976 A1 * 8/2007 Ruokangas ..... G10H 1/02 700/94
2008/0028920 A1 2/2008 Sullivan
2008/0282873 A1 * 11/2008 Kotton ..... G10H 3/06 84/645
2009/0100992 A1 4/2009 Elion
2009/0260508 A1 10/2009 Elion
2009/0314157 A1 12/2009 Sullivan
2010/0037755 A1 2/2010 McMillen et al.
2010/0083807 A1 * 4/2010 Sullivan ..... G10H 1/342 84/315
2010/0083808 A1 * 4/2010 Sullivan ..... G10H 1/342 84/315
2010/0087254 A1 * 4/2010 Sullivan ..... G10H 1/342 463/37
2010/0263521 A1 * 10/2010 Ierymenko ..... G10D 3/04 84/726
2011/0011248 A1 1/2011 Elion
2011/0132180 A1 * 6/2011 Gobbers ..... G10H 1/14 84/622
2011/0303075 A1 12/2011 McMillen et al.
2012/0106758 A1 * 5/2012 Bonada ..... G10L 21/0272 381/94.3
2013/0074680 A1 3/2013 Elion
2014/0283670 A1 * 9/2014 Eventoff ..... G10H 3/00 84/723
2016/0071430 A1 3/2016 Claps
2016/0372098 A1 * 12/2016 Nelson ..... G10H 3/143
2017/0116974 A1 * 4/2017 McMillen ..... G10H 3/18
2017/0178611 A1 * 6/2017 Eventoff ..... G10H 1/342
2017/0229105 A1 * 8/2017 Sullivan ..... G10H 3/188
2017/0301331 A1 * 10/2017 McMillen ..... G10H 3/18
2018/0102120 A1 * 4/2018 Eventoff ..... G10H 1/0558

OTHER PUBLICATIONS

U.S. Notice of Allowance dated Jan. 17, 2017 issued in U.S. Appl. No. 15/296,979.
U.S. Supplemental Notice of Allowance dated Feb. 15, 2017 issued in U.S. Appl. No. 15/296,979.
PCT International Search Report and Written Opinion dated Feb. 2, 2017 issued in PCT/US2016/057672.
U.S. Notice of Allowance dated Oct. 4, 2017 issued in U.S. Appl. No. 15/448,471.
PCT International Preliminary Report on Patentability dated Apr. 24, 2018 issued in PCT/US2016/057672.

* cited by examiner

FRET SCANNERS AND PICKUPS FOR STRINGED INSTRUMENTS

RELATED APPLICATION DATA

The present application is a continuation of and claims priority under 35 U.S.C. 120 to U.S. patent application Ser. No. 15/448,471 entitled Fret Scanners and Pickups for String Instruments filed Mar. 2, 2017, which is a continuation of and claims priority under 35 U.S.C. 120 to U.S. patent application Ser. No. 15/296,979 entitled Fret Scanners and Pickups for String Instruments filed Oct. 18, 2016, which is a non-provisional and claims priority under 35 U.S.C. 119(e) to U.S. Provisional Patent Application Ser. No. 62/244,590 entitled Guitar Scanner and Pickup to Improve Synthesizer Response filed Oct. 21, 2015 . The entire disclosures of both of the above-referenced applications are incorporated herein by reference for all purposes.

SUMMARY

According to a particular class of implementations, a stringed instrument includes a body having a bridge and a saddle mounted thereon. The instrument includes a neck and a headstock. A nut is disposed where the neck and the headstock meet. The headstock has a plurality of tuning machines mounted thereon. A fretboard is mounted on the neck and the body. The fretboard extends from the nut and has a plurality of electrically conductive frets. The instrument has a plurality of electrically conductive strings. Each string extends from a corresponding one of the tuning machines, over the nut, parallel with the fretboard, over the saddle, and is secured to the bridge. The stringed instrument includes fret scanning circuitry configured to conduct a sequence of full board scans. Each full board scan includes selectively applying drive signals to the strings, selectively measuring fret signals resulting from the drive signals for adjacent pairs of the frets, and generating fret data using the fret signals. The fret data represent one or more fret hits. Each fret hit represents a corresponding one of the pairs of frets bridged by a corresponding one of the strings. The fret scanning circuitry is further configured to compare the fret data for consecutive full board scans, determine that an amplitude of a first fret signal for a first pair of frets and a first string and representing a first fret hit declines by less than a dithering gap amount for each of a first number of the consecutive full board scans, and retain the first fret hit as a valid fret hit even if the amplitude of the first fret signal falls below a fret hit threshold.

According to some implementations, the fret scanning circuitry is configured to release the first fret hit after the first fret signal declines by less than the dithering gap amount for each of a second number of the consecutive full board scans. According to a specific implementation, the first number is greater than or equal to a programmable dither threshold count, and the second number is greater than or equal to a programmable dither timeout count.

According to some implementations, the fret scanning circuitry is configured to determine, before starting to determine that the amplitude of the first fret signal declines, that the first fret hit was reported in at least one previous full board scan, and that a number of simultaneous fret hits are currently being reported.

According to some implementations, the fret scanning circuitry is configured to determine that an amplitude of a second fret signal for a second pair of frets and the first string exceeds an amplitude threshold higher than the fret hit threshold, the second pair of frets trailing the first pair of frets.

According to some implementations, the fret scanning circuitry is configured to register the first fret hit only if the first fret hit exceeds the fret hit threshold for a third number of the consecutive scans. According to a specific implementation, the fret hits correspond to different note transition types, and the fret scanning circuitry is configured to employ different consecutive scan thresholds to register a fret hit for the different note transition types.

According to some implementations, the fret scanning circuitry is configured to determine, for each of the strings, if the string is being touched but not fretted. According to a specific implementation, the fret scanning circuitry is configured to determine, for each of the strings, if the string is being touched but not fretted by charging the string, generating a value representing the charge on the string, and comparing the value to a touch scan threshold.

According to some implementations, the fret scanning circuitry is configured to vary the fret hit threshold based on a number of the strings being simultaneously fretted.

According to another class of implementations, a fret scanning system is provided for use with a string instrument having a plurality of electrically conductive frets and a plurality of electrically conductive strings. The fret scanning system includes circuitry and one or more processors configured to use the circuitry to conduct a sequence of full board scans. Each full board scan including selectively applying drive signals to the strings, selectively measuring fret signals resulting from the drive signals for adjacent pairs of the frets, and generating fret data using the fret signals. The fret data represent one or more fret hits. Each fret hit represents a corresponding one of the pairs of frets bridged by a corresponding one of the strings. The one or more processors are further configured to compare the fret data for consecutive full board scans, determine that an amplitude of a first fret signal for a first pair of frets and a first string and representing a first fret hit declines by less than a dithering gap amount for each of a first number of the consecutive full board scans, and retain the first fret hit as a valid fret hit even if the amplitude of the first fret signal falls below a fret hit threshold.

According to some implementations, the one or more processors are configured to release the first fret hit after the first fret signal declines by less than the dithering gap amount for each of a second number of the consecutive full board scans. According to a specific implementation, the first number is greater than or equal to a programmable dither threshold count, and the second number is greater than or equal to a programmable dither timeout count.

According to some implementations, the one or more processors are configured to determine, before starting to determine that the amplitude of the first fret signal declines, that the first fret hit was reported in at least one previous full board scan, and that a number of simultaneous fret hits are currently being reported.

According to some implementations, the one or more processors are configured to determine that an amplitude of a second fret signal for a second pair of frets and the first string exceeds an amplitude threshold higher than the fret hit threshold, the second pair of frets trailing the first pair of frets.

According to some implementations, the one or more processors are configured to register the first fret hit only if the first fret hit exceeds the fret hit threshold for a third number of the consecutive scans. According to a specific implementation, the fret hits correspond to different note transition types, and the one or more processors are configured to employ different consecutive scan thresholds to register a fret hit for the different note transition types.

According to some implementations, the one or more processors are configured to determine, for each of the strings, if the string is being touched but not fretted. According to a specific implementation, the one or more processors are configured to determine, for each of the strings, if the string is being touched but not fretted by charging the string using the circuitry, generating a value representing the charge on the string, and comparing the value to a touch scan threshold.

According to some implementations, the one or more processors are configured to vary the fret hit threshold based on a number of the strings being simultaneously fretted.

According to another class of implementations, systems, methods and computer program products are provided in which fretting data are received that represent fretting hand positions for strings of a stringed instrument. String data are received that represent vibrations of the strings of the stringed instrument. A trigger message is generated for a first string of the stringed instrument. A first fundamental frequency estimate is determined for the first string by performing a spectral analysis of the string data for the first string. A second fundamental frequency estimate is determined for the first string using the fretting data for the first string. The first fundamental frequency estimate is determined to correspond to a harmonic of the second fundamental frequency estimate. The first fundamental frequency estimate is corrected using the second fundamental frequency estimate.

According to some implementations, a pitch estimate is initially reported for the first string based on the first fundamental frequency estimate. After a delay, the pitch estimate is reported for the first string based on the second fundamental frequency estimate. When an amplitude of the string data for the first string falls below a first threshold, a current value of the pitch estimate for the first string is locked. When the amplitude of the string data for the first string falls below a second threshold, reporting of the pitch estimate for the first string is terminated.

According to some implementations, a trigger message is received for a second string of the stringed instrument. A bend signal is received for the second string. The bend signal indicates that the second string is bent parallel to a top surface of the stringed instrument. Reporting of a pitch estimate for the second string based on the fretting data for the second string is inhibited.

According to some implementations, a trigger message is received for a second string of the stringed instrument. A bend signal is received for the second string. The bend signal indicates that the second string is bent parallel to a top surface of the stringed instrument. A fundamental frequency estimate is determined for the second string using the fretting data for the second string. The fundamental frequency estimate for the second string is modified using the bend signal.

According to another class of implementations, a saddle component is provided for mounting adjacent a surface of a stringed instrument and securing an end of a string of the stringed instrument. The saddle component includes a body having a cantilevered structure extending therefrom. The cantilevered structure is configured to receive the string and to mechanically vibrate with a vibration of the string. The cantilevered structure includes a unimorph piezoelectric element oriented such that a primary planar orientation of the piezoelectric element is substantially perpendicular to the surface of the stringed instrument. The piezoelectric element is mechanically biased such that the piezoelectric element is deformed relative to the primary planar orientation.

According to some implementations, the piezoelectric element is disposed in a slot in the cantilevered structure, and the piezoelectric element is mechanically biased by mechanical components in the slot.

According to some implementations, the piezoelectric element is disposed in a slot in the cantilevered structure, and the piezoelectric element is mechanically biased by a cured material that secures the piezoelectric element in the slot.

According to some implementations, the piezoelectric element is also mechanically biased due to tension of the string such that the piezoelectric element is deformed in a direction substantially perpendicular to the surface of the string instrument.

According to another class of implementations, a saddle component is provided for mounting adjacent a surface of a stringed instrument and securing an end of a string of the stringed instrument. The saddle component includes a body having a cantilevered structure extending therefrom. The cantilevered structure is configured to receive the string and to mechanically vibrate with a vibration of the string. The saddle component further includes an inductor coil and an inductor core element. The inductor coil and the inductor core element are integrated with the body and the cantilevered structure of the saddle component such that movement of the cantilevered structure relative to the body causes corresponding movement between the inductor coil and the inductor core element, thereby changing an inductance of the inductor coil.

According to some implementations, the inductor coil is integrated with a portion of the body of the saddle component adjacent the cantilevered structure, and the inductor core element extends from the cantilevered structure into a cavity of the inductor coil.

According to some implementations, the inductor coil is integrated with the cantilevered structure, and the inductor core element extends from a portion of the body of the saddle component adjacent the cantilevered structure into a cavity of the inductor coil.

According to some implementations, the saddle component includes a piezoelectric element integrated with the cantilevered structure. According to a specific implementation, the piezoelectric element is a unimorph piezoelectric element oriented such that a primary planar orientation of the piezoelectric element is substantially perpendicular to the surface of the stringed instrument. The piezoelectric element is mechanically biased such that the piezoelectric element is deformed relative to the primary planar orientation.

A further understanding of the nature and advantages of various implementations may be realized by reference to the remaining portions of the specification and the drawings.

DETAILED DESCRIPTION

Techniques are described herein that handle various aspects of converting the mechanical energy of instrument strings to digital representations for use in a variety of applications. These techniques include designs for string transducers (e.g., pickups), fret scanners, and pitch detection systems, as well as signal processing and other techniques that enhance the performance and reliability of such designs. Reference will now be made in detail to specific implementations. Examples of these implementations are illustrated in the accompanying drawings. It should be noted that these examples are described for illustrative purposes and are not intended to limit the scope of this disclosure. Rather, alternatives, modifications, and equivalents of the described implementations are included within the scope of this disclosure as defined by the appended claims. In addition, specific details may be provided in order to promote a thorough understanding of the described implementations. Some implementations within the scope of this disclosure may be practiced without some or all of these details. Further, well known features may not have been described in detail for the sake of clarity.

Figure 1:
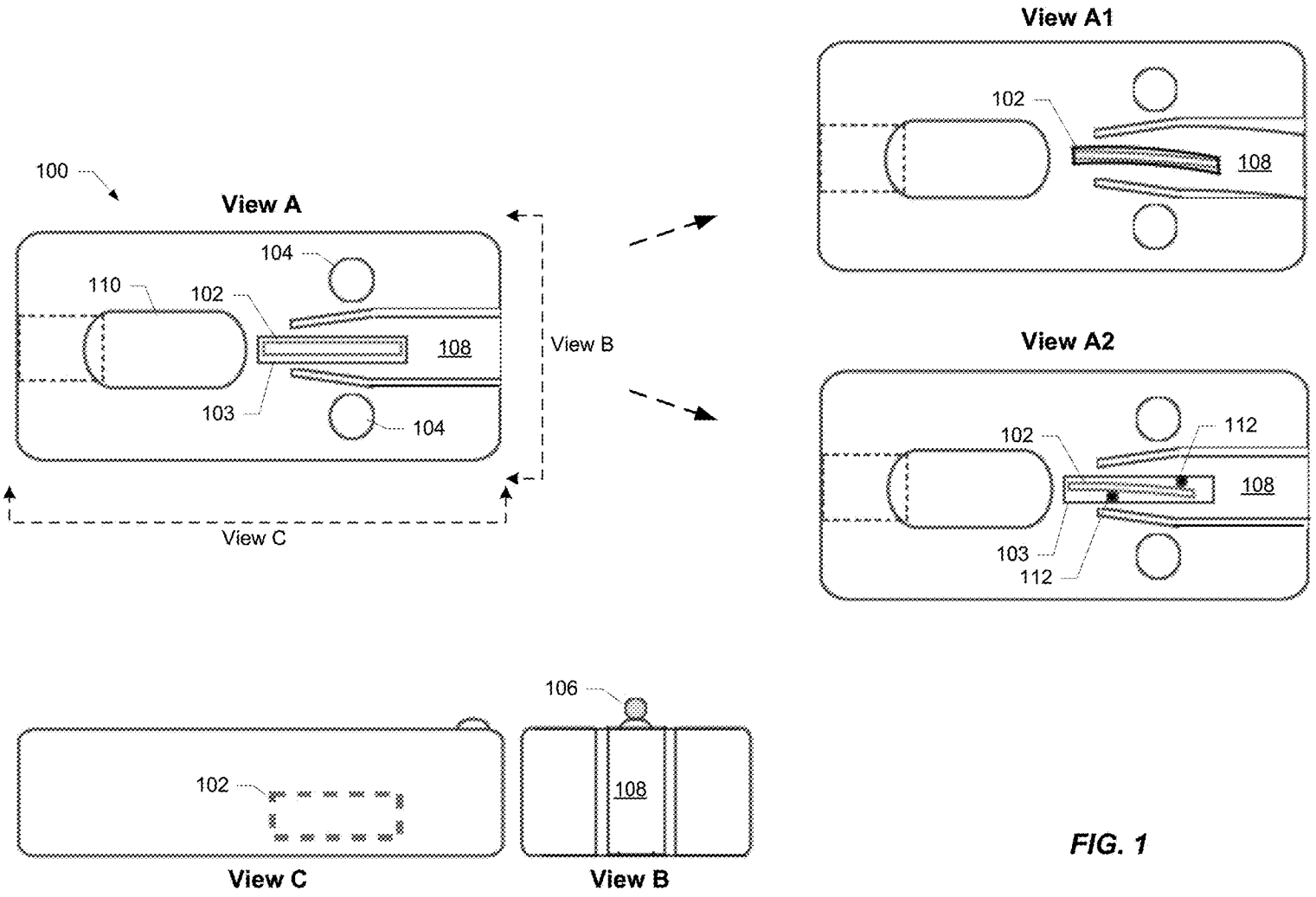
FIG. 1 includes simplified representations of various views of an implementation of a pickup for a stringed instrument.

FIG. 1 shows multiple views of a saddle component 100 for transducing the mechanical energy of a string of a stringed instrument to an electrical signal. Saddle component 100 includes a unimorph piezoelectric element 102 in a slot or cavity 103. View A is a top view that shows through-holes 104 by which saddle component 100 is secured to the bridge of the instrument (not shown). As shown in end view B, instrument string 106 (shown in cross-section) is routed over flexing beam 108 (also referred to as a tone arm). Instrument string 106 is then routed through aperture 110 through which the end of the string is secured. View C is a side view of saddle component 100 which shows a dashed line representation of piezoelectric element 102 relative to the body of saddle component 100.

As is well known, piezoelectric materials convert mechanical energy to electrical energy or vice versa. A unimorph piezoelectric element is a piezoelectric element having a single piezoelectric layer (e.g., PZT or lead zirconate titanate) bonded to a non-piezoelectric elastic layer (e.g., steel or titanium) as illustrated, for example, by the cantilever mounted piezoelectric element 200 shown in FIG. 2. The application of mechanical stress, e.g., bending, to such a piezoelectric element results in electrical charge generation that represents the degree of deformation. According to particular implementations described herein, it is the primary mode of a string's vibration parallel to the top surface of the instrument that causes bending of a piezoelectric element similar to the bending illustrated in FIG. 2.

Figure 2:
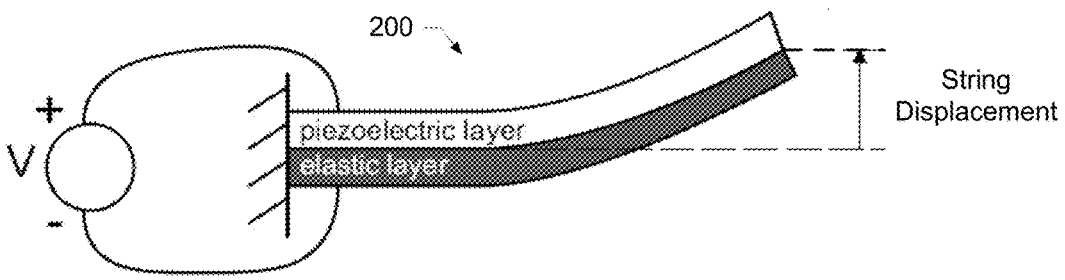
FIG. 2 is a simplified representation of a unimorph piezoelectric device.

Referring again to FIG. 1, flexing beam 108 is configured such that its greatest degree of mechanical freedom is in the direction of the primary mode of the string's vibration, and such that this motion will cause piezoelectric element 102 to deform from its primary planar orientation back and forth along with the string (e.g., as shown in FIG. 2), thereby enabling capture of the string's vibration as represented by a signal corresponding to the resulting charge generation. The main body of saddle component 100 may be constructed from glassed filled nylon or an engineering thermoplastic such as, for example, Delrin. Saddle component 100 (as well as others of the saddle components described herein) may be coated with a heat sink material (e.g., anodized aluminum) which may, for example, be put into a mold for the saddle component before injection of the nylon or thermoplastic.

Some conventional pickup designs have difficulty or are intentionally designed to inhibit the transducing of string harmonic components that are perpendicular to the face of the instrument. Instrument strings normally have a primary mode of vibration that is parallel to the face of the instrument. However, musicians often intentionally employ side-to-side bending of a string to produce pitch variations which force many of a string's harmonic components out of the plane that is parallel to the face of the instrument. Such harmonic components may therefore be lost when pickups are used to do not transduce such components well. According to a particular class of implementations, a unimorph piezoelectric element is mechanically biased, e.g., deformed relative to its primary planar orientation, such that it captures components of the fundamental and harmonics of the string's vibrations that are both parallel and perpendicular to the face of the instrument. Two such implementations are illustrated in FIG. 1.

View A1 of FIG. 1 is a top view of saddle component 100 in which piezoelectric element 102 is deformed by the bending of tone arm 108 as shown while glue, cement, or epoxy securing piezoelectric element 102 in slot 103 is hardening. When the glue, cement, or epoxy is sufficiently hardened, tone arm 108 may be returned to its relaxed state with a resulting mechanical bias on element 102. An alternative implementation is shown in View A2 in which mechanical components (e.g., bumps or cylinders 112) are included in slot 103 that deform piezoelectric element 102 once it's been inserted. As will be appreciated, the depicted deformations are not shown to scale as they are for illustrative purposes. According to some implementations, piezoelectric element 102 is a PZT5 piezoelectric ceramic component manufactured by Shenzen Apple Vista Ltd. of Shenzen, Guangdong, China.

An unbiased unimorph responds only to pressure regardless of the direction. As saddle component 100 converts the physical displacement of the string into an electrical signal, the mechanical biasing of piezoelectric element 102 provides the polarity of this electrical signal. That is, without the bias (view A), a movement either up or down from center (relative to the page) would result in an increase in pressure applied to the element and therefore a positive excursion of the electrical signal for either direction. With the mechanical bias (e.g., view A2), an upward motion of the tonearm releases pressure from the element (causing a negative electrical excursion) and a downward motion increases pressure on the element (positive electrical excursion). The polarity created by mechanical bias thereby enables the predictable operation of the system.

Moreover, there is another mechanical biasing action in the plane perpendicular to the face of the instrument caused by the tension of the instrument. As a result, movement of the string movement toward the face of the instrument causes an increase in pressure (positive electrical signal) and movement of the string away from the face decreases pressure (negative signal). This enables the capturing of out of plane harmonics associated with, for example, bent notes as described above.

Figure 3:
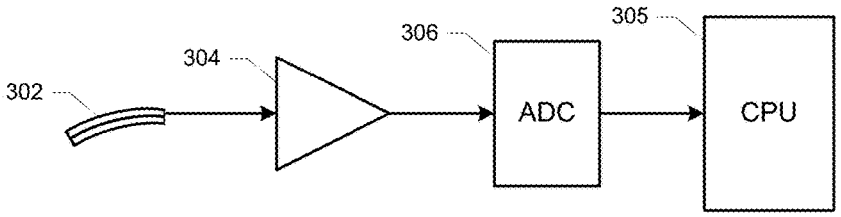
FIG. 3 is a simplified representation of a signal processing chain for use with a pickup.

FIG. 3 shows an example of a signal processing chain that may be employed by various implementations to use the pickup output generated by a unimorph piezoelectric element (e.g., as described above) to determine the pitch of a corresponding instrument string as well as other purposes such as, for example, driving an electromagnet to provide a sustain function of the string or any of a variety of other functions or effects. The diagram of FIG. 3 illustrates the signal processing chain for one string of an instrument, but it will be understood that the components and/or functional blocks for depicted chain may be reproduced for each string of an instrument.

A unimorph piezoelectric element 302 generates an electrical signal in response to vibration of an instrument string. A preamp 304 buffers the signal from element 302 so that it can be converted into the digital domain for processing by CPU 305 by an analog-to-digital converter (ADC) 306. CPU 305 may be any of a wide variety of digital signal processors or controllers suitable for providing the processing capabilities and functionalities described herein, may be integrated with or remote from the stringed instrument, and may be implemented in hardware, software, firmware, or any combination thereof. For example, CPU 305 may be included in a StringPort, a hardware and software bundle for polyphonic instruments from Keith McMillen Instruments various characteristics of which are described in U.S. Pat. No. 8,581,086 entitled Computer Interface for Polyphonic Stringed Instruments, the entire disclosure of which is incorporated herein by reference for all purposes. Alternatively, CPU 305 may be implemented using one or more microprocessors, one or more application-specific integrated circuits, one or more field-programmable gate arrays, or any suitable type of device; each of which may be onboard or remote from the stringed instrument.

Figure 4:
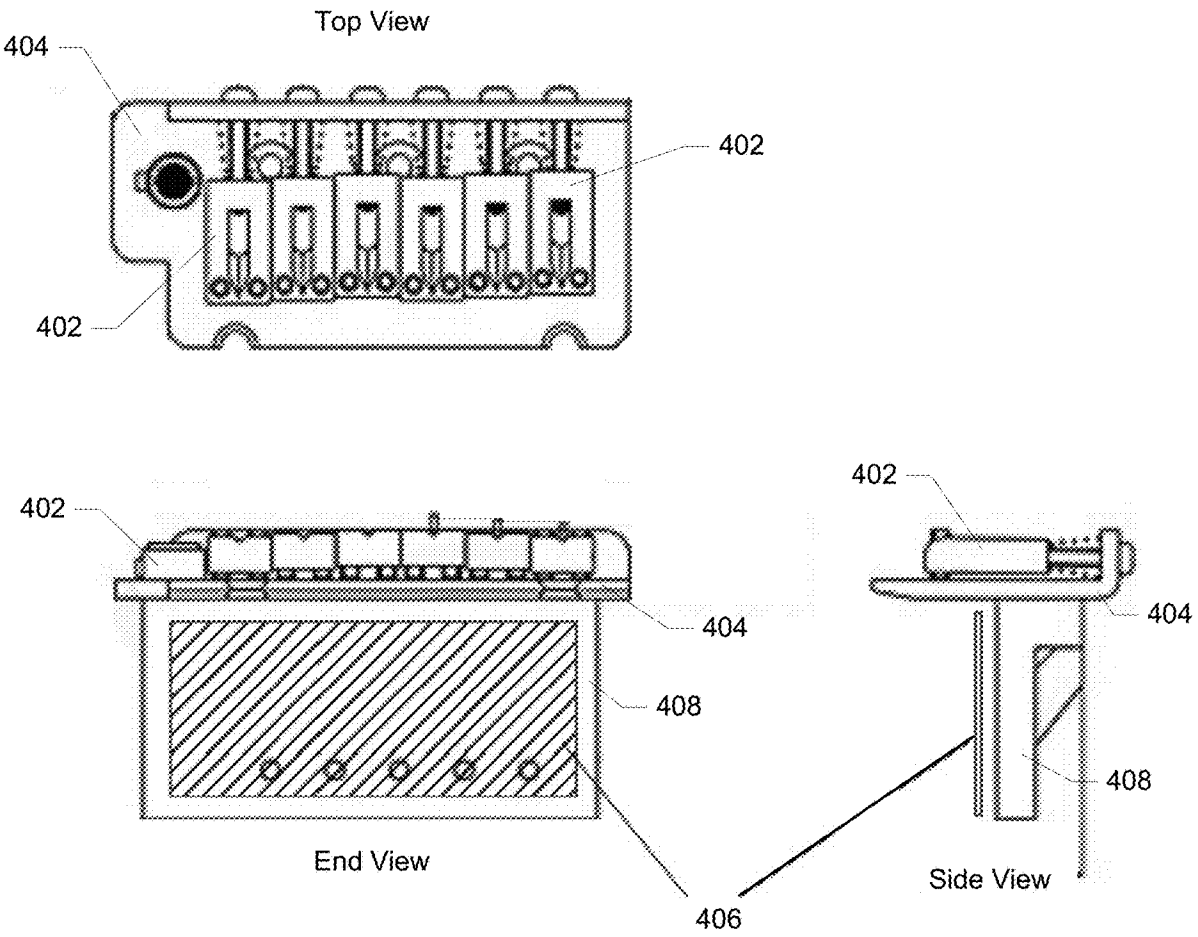
FIG. 4 shows six pickups arranged on a bridge of a stringed instrument.

FIG. 4 shows an example of a particular implementation in which six combined sustainer/pickup components 402 are mounted on the bridge 404 of a Stratocaster style electric guitar. A printed circuit board assembly PCBA 406 (e.g., including the DSP and/or codecs of the signal processing chain such as the one shown in FIG. 3) may be attached to either the front or the back of the Stratocaster's spring plate 408 which is oriented at a right angle to the bridge and extends into the body of the guitar. Such an approach may be advantageous in that it may reduce the number of conductors external to the guitar that might otherwise be required to achieve the functions described herein. That is, according to some implementations, each string might have 4 or 5 associated conductors connected to the signal processing chain. This could mean up to 30 conductors that would need to be routed off the guitar if the signal processing chain were located remotely. By contrast, the approach depicted in FIG. 4 may be implemented such that only four conductors leave the bridge, i.e., power, ground, serial data in, and serial data out. As will be appreciated, the scope of this disclosure is not limited to guitars as the basic principles described and illustrated herein apply to a wide range of stringed instruments.

Accurately determining the pitch of a vibrating string based on a pickup signal typically takes several cycles of the string's vibration. For a low-pitched string, this can be as long as 25-50 milliseconds. Depending on the application (e.g., controlling a synthesizer), this may be too long from the musician's perspective. A variety of fret scanning techniques have been developed over the years to address this issue. Such techniques use data gathered from the frets and strings of an instrument to determine the musician's fretting hand position, and thus the approximate pitch of the intended note. Having this information before the string starts to vibrate can help improve the performance of pitch tracking techniques. One such technique for determining the fretting hand position is described in U.S. Pat. No. 4,468,997 entitled Fretboard to Synthesizer Interface Apparatus, the entire disclosure of which is incorporated herein by reference for all purposes.

Fret scanning techniques will now be described that use fret signals from adjacent pairs of frets to provide robust indicators of fretted instrument strings. A stringed musical instrument is outfitted with conductive strings and frets that allow the fret board of the instrument to be scanned for detection of fretted notes that are intended to be played. According to some implementations, strings that are unfretted but touched are also detected. The information derived from these detections enable conversion of the playing of the instrument into digital information that may be used, for example, to control a synthesizer.

Figure 5:
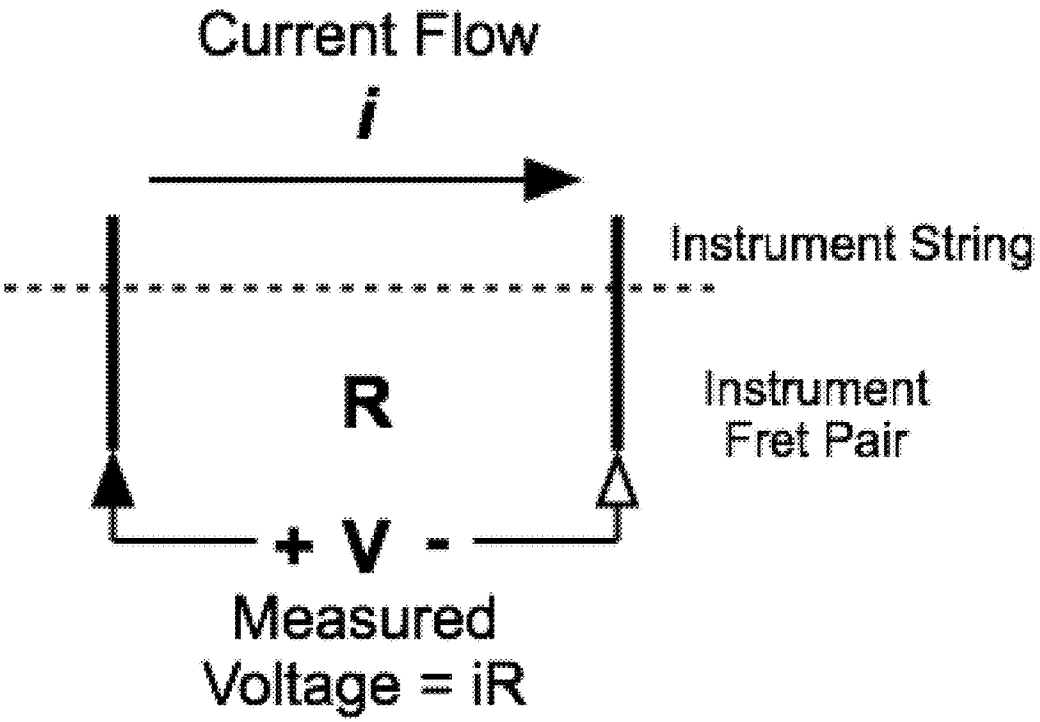
FIG. 5 illustrates Ohm's law in the context of fret scanning.

The fundamental principle applied by fret scanning techniques enabled by the present disclosure is Ohm's Law as embodied by an electrical current flowing through a circuit that includes an instrument string and one or more frets, and the measurement of a voltage across a resistance in that circuit. Applying Ohm's Law allows for calculation of the current flow from a known resistance the measured voltage. In the case of the stringed instrument and as shown in FIG. 5, the resistance through with the current flows is a conductive instrument string and the high impedance points of voltage measurement represented by a neighboring pair of frets. Detecting a voltage above a noise threshold is sufficient to determine if a fret pair is being bridged by the string that is being driven.

Extending these principles to multi-stringed, multi-fretted, instruments can be thought of as treating the strings and fret pairs as an array of sensors. The strings are sequentially driven with current and fret pairs are sequentially selected for voltage measurements by an array of multiplexers. These measurements are sampled by an analog-to-digital converter (ADC) to generate information that is used to determine when a particular fret pair is bridged. The string current drive sequencing, fret pair multiplexing, ADC sampling, and post processing is performed by an embedded microcontroller.

Figure 6:
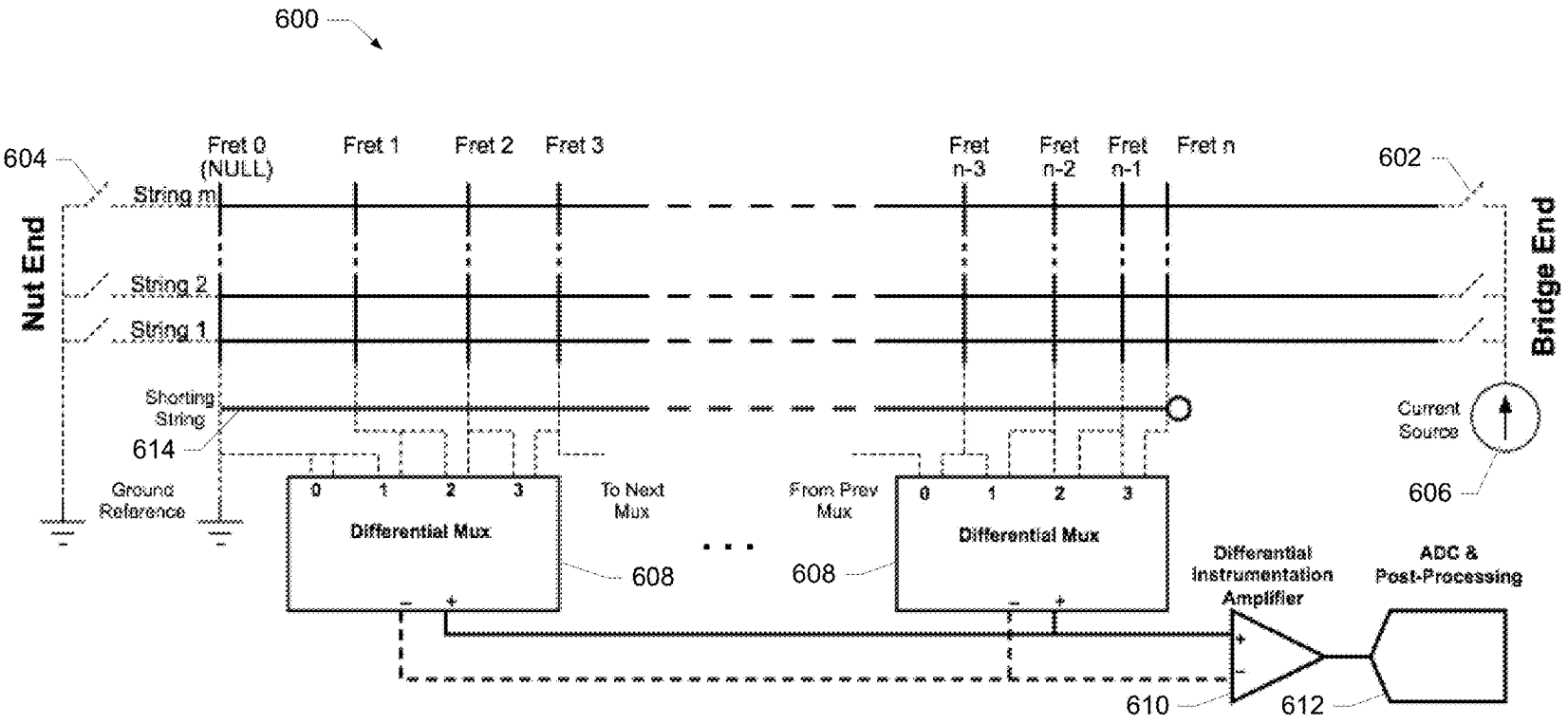
FIG. 6 is a simplified representation of a particular implementation of a fret scanning system.

FIG. 6 is a simplified block diagram of a particular implementation of a fret scanning system 600. The strings and frets of an instrument are depicted as an addressable m by n array of sensors. Addressing of the strings involves selecting pairs of switches 602 and 604 (e.g., field effect transistors or FETs) for each string at the bridge and nut ends, respectively, of the fret board to allow current from a current source 606 to flow through the string from the bridge end to the ground sink at the nut end. Differential multiplexers 608 are connected to the frets and are used to select the fret pair for which the voltage across the pair will be differentially amplified (by amp 610) to determine if a current carrying string is bridging that fret pair. By sequencing through the strings and frets, the entire fret board is scanned as a microcontroller with an ADC (represented by ADC & Post-Processing 612) analyzes the data to determine which, if any, fret has been depressed for each string. These events are referred to herein as "fret hits." As will be described, fret hits may be further analyzed and "debounced" before forwarding the data to other systems, e.g., a synthesizer or a pitch detection system.

Note that an additional string referred to as the "shorting string" 614 is shown in FIG. 6. This is a wire of low resistance in the range similar to the resistances of the instrument strings (e.g., 10s of millohms). Shorting string 614 is electrically connected to each fret with the end of at the bridge being connected to fret n (but not otherwise terminated), and the end at the nut being connected to ground. According to a particular implementation, these connections are made on a PCBA embedded in the neck of the instrument that includes much of the circuitry such as, for example, the differential multiplexers. The main purpose of shorting string 614 is to allow detection of fretted notes that do not bridge two frets. Fret 1 is one example of this. Other single examples may arise for other frets depending on the musician's playing style. Without shorting string 614 to provide a path to ground for the active string's current, the selection of Fret 1 and/or other single fretted notes could not be detected.

Also, note the special case of "Fret 0" also called the "NULL Fret". The connection to the zero$^{th}$ fret multiplexer address allows for measurement of the NULL condition, comparing the ground reference at the nut end to itself. This information can be used to determine the voltage offset error of differential instrumentation amplifier 610. This may be a critical design consideration for some implementations due to the large gains required to detect small amounts of current (e.g., 100-150 mA) through the very low resistance of the instrument's strings (e.g., tens of milliohms per inch 2-3 ohms per 24-25 inches 80-140). Depending on the implementation, the NULL sample can be sent through a null offset difference amplifier stage or it can simply be sent through the ADC for correction in the microcontroller firmware.

Figure 7:
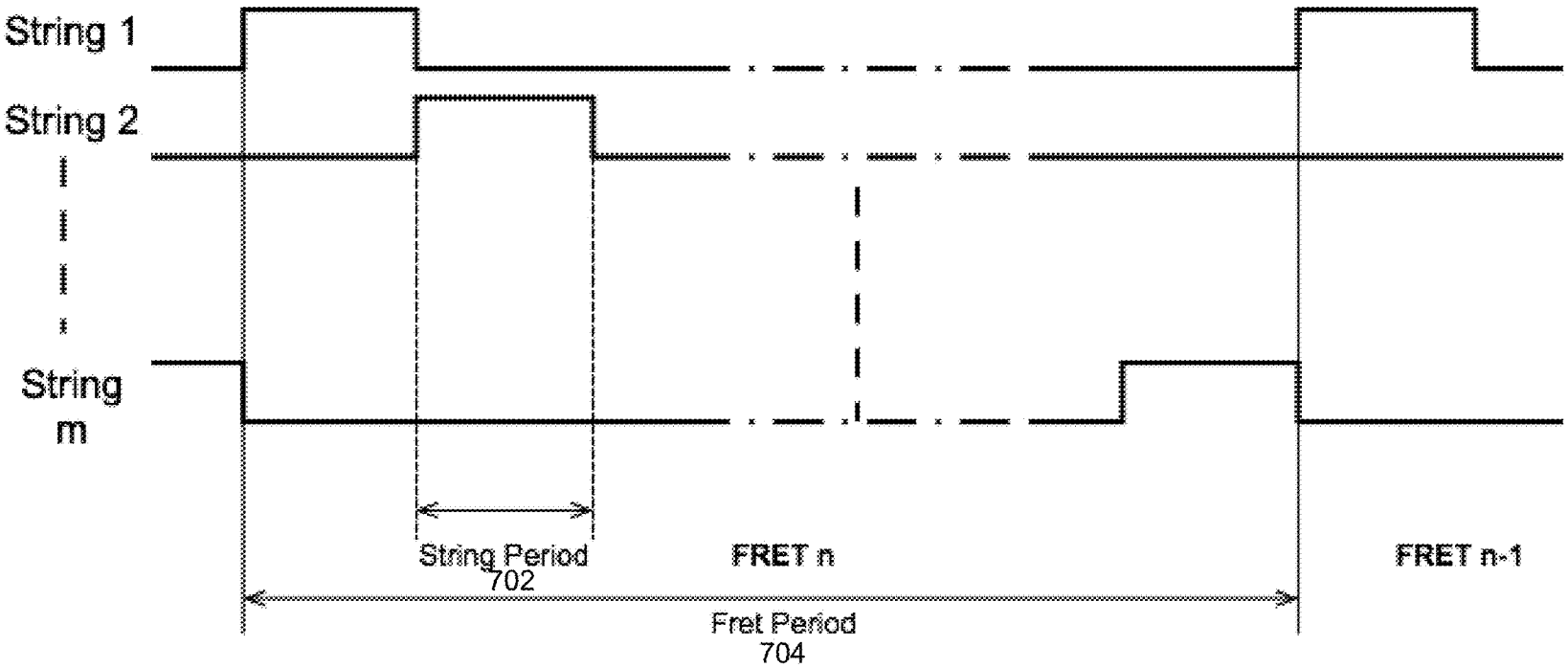
FIG. 7 is a simplified representation of drive signals for the fret scanning system of FIG. 6.

An example of a fret board scanning sequence for an implementation of a fret scanning system enabled by the present disclosure is represented by the timing diagram of FIG. 7. The depicted fret board scan begins by selecting (e.g., with the corresponding multiplexer) the fret pair closest to the instrument's bridge (e.g., frets n and n−1 in FIG. 6), and sequentially activating the strings from string 1 to string m. Activating a string involves closing both electronic switches for that string (e.g., switches 602 and 604) which drives the string with current (e.g., from current source 606). After voltages across the selected pair of frets have been captured for all of the strings, the fret address is decremented to the next fret pair (e.g., frets n−1 and n−2) and the sequential string activation repeats. Note that in FIG. 7 and elsewhere in this description, a fret pair may sometimes be referred to by the leading fret, i.e., the fret in the pair that is closer to the bridge. It should also be noted that the order of fret selection (e.g., from bridge to nut or nut to bridge) may be chosen based on the direction of current flow.

The period of time during which any given string is being driven is referred to as the string period (e.g., 702). The period of time during which the strings are sequentially activated for a given pair of frets is referred to as the fret period (e.g., 704). Activation of the strings for each successive pair of frets continues until the fret period for fret 0 (the NULL fret) has completed, after which the process begins again at fret n. The process of sequencing through all frets and strings of the instrument is referred to as a full board scan. During each string period, a signal for a corresponding string/fret pair combination is amplified (e.g., by differential amplifier 606) for ADC conversion and analysis by the microcontroller firmware (e.g., 612).

According to some implementations, a secondary drive of each string is provided to allow for detection of open strings that are being touched but not fretted. This "touch scan" might be performed, for example, once for each full bridge scan after the fret period for the NULL fret and before the next full bridge scan begins. During the touch scan, each string is connected to a current source and is left floating without providing a path to ground to sink the current. This results in a small amount of charge building up on the string. After the charge is applied to the string, an ADC captures the string's voltage level. If the string is being touched, this level will register lower than the level for a string which is being neither fretted nor touched.

As will be appreciated, this touch scan may be implemented using at least some of the same hardware as that used to implement the fret scanning described above. For example, in the implementation depicted in FIG. 6, the charging of each string may be achieved by connecting each string to current source 606 by closing the corresponding switch 602 but leaving the corresponding switch 604 at the other end of the string open. The resulting voltage on each string could be captured by a dedicated multiplexer (not shown) and then provided to the same ADC and post processing circuitry 612. Alternatively, a dedicated set of hardware components could be used to implement the touch scan. Such an approach might allow for a touch scan to be performed at some point while the main fret scanning process is ongoing, with the charging and voltage measurement for a given string being performed at any point at which the string is not being activated for the main fret scanning process.

Depending on the implementation, careful consideration may be required regarding the design of the differential instrumentation amplifier (e.g., amplifier 610). For implementations in which small currents are driven through the very low resistance of the instrument's strings, a large amplifier gain is required to condition the signal (which in some cases may be fractions of a millivolt) into a voltage that can be read by the ADC. And due to the large gains involved (e.g., 200-400), the differential amplifier preferably has a sufficiently high bandwidth and a sufficiently fast slew rate to stabilize the signal and allow ample time for the ADC to capture its measurement before the next string period. Off-the-shelf operational amplifiers may be used as long as the gain-bandwidth ratio, input offset voltage, and common-mode rejection ratio ensure the desired level of performance and noise immunity. In addition, it is preferable that the amplifier inputs present a very high impedance to ensure that no appreciable amount of current directed down the instrument strings flows into the measurement points. Examples of the analog behavior of a fret scanning system at the output of the differential amplifier is represented for two different scenarios in FIGS. 8A and 8B.

Figure 8A:
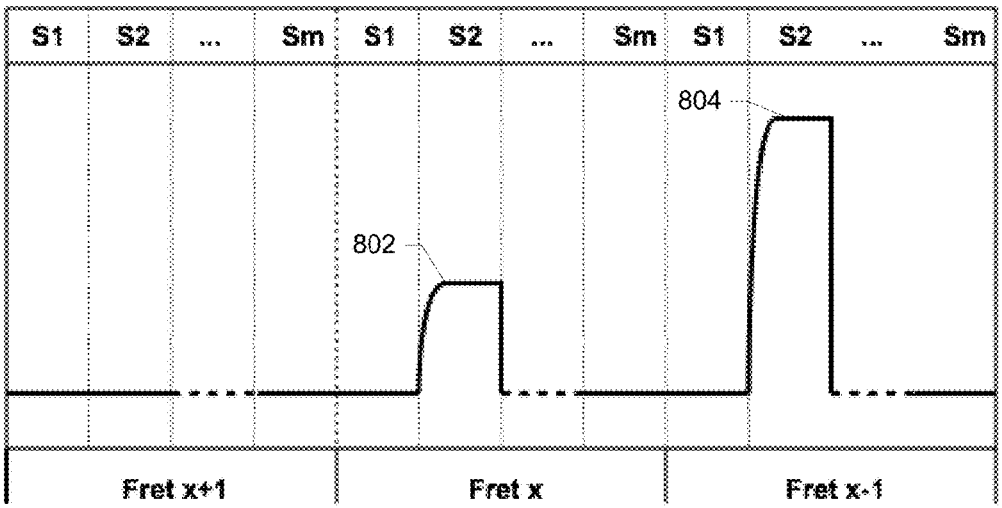
FIG. 8A and FIG. 8B are simplified representations of fret data generated by the fret scanning system of FIG. 6.

The waveform shown in FIG. 8A illustrates three successive fret period for the case in which a single string (string 2) has been fretted (at fret x), i.e., fret x and fret x−1 have been bridged by string 2 with fret x being the leading fret and fret x−1 being the trailing fret (i.e., the next fret in the direction of the nut). During the fret period for fret x+1 (i.e., the fret next to fret x in the direction of the bridge), no appreciable signal is seen at the output of the differential amplifier because frets x+1 and x are not both connected to any string being driven. However, when string 2 is driven during the fret period for fret x (during which the voltage measurement points for fret x and fret x−1 are selected by the differential multiplexers), a small voltage is detected and amplified as represented by pulse 802. Note the rise time depicted represents suitable bandwidth and slew rate performance of the differential amplifier, with the flat, stable, center of pulse 802 being a good point at which to perform the analog to digital conversion.

Also note that the fret period for fret x−1 (as well as the subsequent non-depicted fret periods) shows a data pulse for string 2 (e.g., pulse 804). As represented in the figure, these subsequent pulses are typically larger than the pulse for the leading fret due to the resistance of the shorting string which is in parallel with the resistance between the bridged frets (x and x−1) but carrying all of the current for subsequent fret pairs.

Figure 8B:
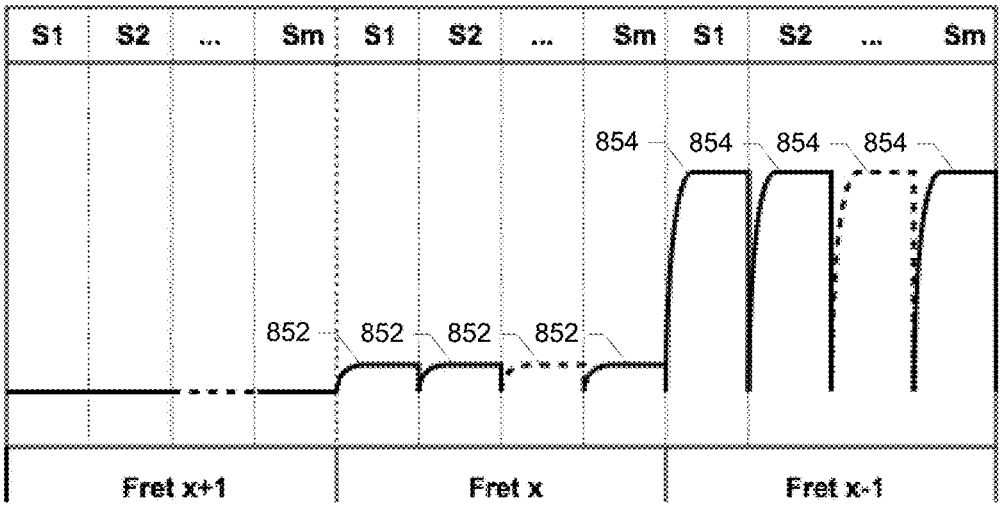

FIG. 8B illustrates a more extreme operating condition in which every string on fret x has been depressed. Such a condition might occur, for example, during formation of a barre chord, or as a result of the use of a capo on that fret. The depicted case illustrates the challenge of accurately detecting which fret pair the musician intended to select. As with the example of FIG. 8A, fret x is the valid fret. However, because multiple strings are fretted simultaneously, and because only one string is driven at a time, the current gets divided among multiple inactive strings which electrically merge at the shorting string after the point of measurement. As a result, the amount of current flowing through the actual driven string is much smaller, decreasing in amplitude as more strings simultaneously bridge the same fret pair, and being minimized when all strings are fretted at the same fret as shown. This is represented by pulses 852 during the fret period for fret x.

On the other hand, the trailing but invalid pulses are much larger (as represented by pulses 854 captured during the fret period for fret x−1). Despite the multiple strings fretted, these invalid pulses are nearly as large in amplitude as the invalid pulses in the case of the single fretted string (e.g., pulse 804). This is, again, due to the fact that these measurements are the result of a single current path through the shorting string. Variations in pulse amplitude are further exacerbated by differences in resistance between different instrument strings and differences in the distance between successive frets. Given the wide range of variation in amplitude of the pulses associated with the leading fret and subsequent invalid pulses, careful attention to the application of a fret hit threshold must be paid in order to avoid registering a hit on the flat halftone of an actual fretted note.

As will be appreciated, the foregoing constraints should be considered when choosing amplifier gains and determining the amount of current to drive down the strings. Simply choosing higher gain or higher drive current may not improve overall system performance in that higher gains may tax the capabilities of the amplifier, while higher current will increase power consumption and may inject higher noise levels into the ground reference.

Another consideration that should be taken into account is the fact that the relatively strong current drive applied to the strings may be detected by the instrument's conventional magnetic pickups. Therefore, for some implementation, the strings are driven at a frequency that is out of the audio band in order to prevent noise from being generated and amplified by analog audio equipment. For example, in the context of the scanning process described above, the frequency of the string drive is the inverse of the scanning fret period and the duty cycle of the string drive is 1/m, where m is the number of strings on the instrument. In a typical six-string guitar application, in order to keep the periodic string drive frequency at 20 Khz, the individual string drive period would need to be the reciprocal of 20 KHz*6 (strings)=120 KHz, which is approximately 8.33 microseconds. These factors should be taken into consideration when evaluating microcontroller and ADC capabilities. In addition, jitter due to firmware control of the string drive should be mitigated in order to prevent modulated frequencies from being emitted by the driven strings and picked up by the instrument's magnetic pickups.

Figure 9:
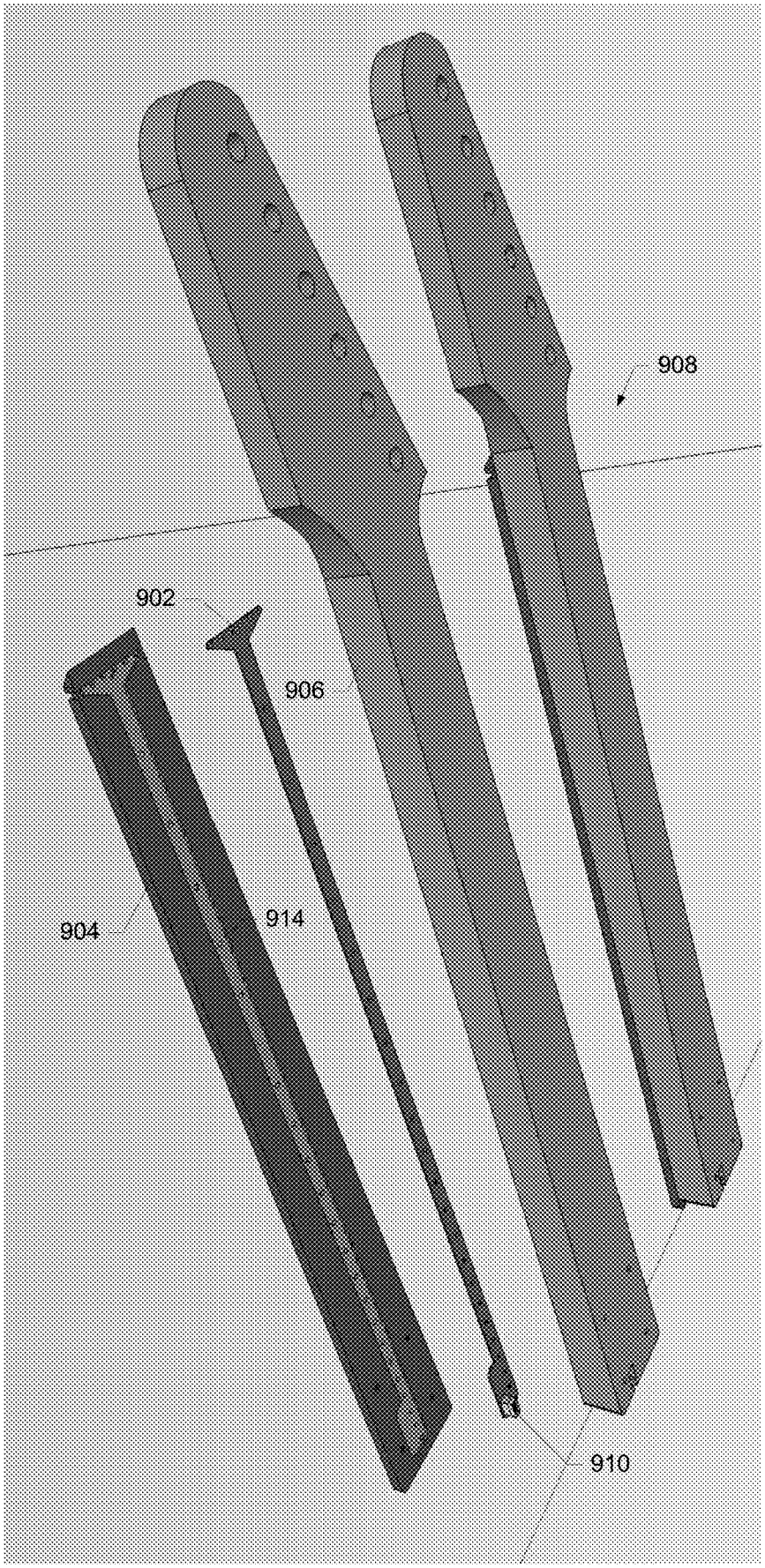
FIG. 9 includes exploded and unexploded representations of the neck of a stringed instrument in which a printed circuit board assembly of a fret scanning system is embedded.

The mechanical integration of fret scanning systems enabled by the present disclosure may vary considerably and will be dictated, at least in part, by the type of stringed instrument. According to a particular class of implementations, the array of multiplexers may be distributed along a slim PCBA embedded in the neck of the instrument with a cable connected to another PCBA installed elsewhere in the body of the instrument (e.g., PCBA 406 of FIG. 4). An example of such an implementation is shown in the exploded view of FIG. 9 in which PCBA 902 is inserted in a corresponding cavity on the underside of finger board 904 before being secured to guitar neck 906 as shown in assembled view 908. The cable (which might be connected at connector 910) might include, for example, conductors for transmitting the differential analog data from the addressed fret pairs, the fret/string addressing data to the multiplexers, power, and ground return. The body PCBA (not shown) might include the ADC, the microcontroller, and interfaces to other systems, e.g., a synthesizer or a pitch detection system. Some or all of the amplification stages could reside on either the neck PCBA or the main body PCBA. It may be desirable to buffer and/or electrically shield the differential analog data from the fret pairs before amplification, particularly for implementations in which the amplification occurs on a remote assembly.

Figure 10:
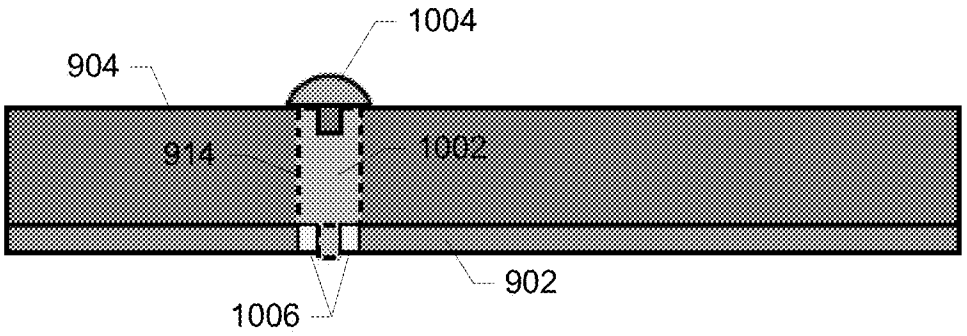
FIG. 10 illustrates a connection between a fret and a printed circuit board assembly.

Electrical connections to the frets may be made with wires, studs, or posts embedded in the fingerboard of the instrument that provide a conductive path from the conductive frets to circuitry on the PCBA embedded in the neck of the instrument. Referring again to the implementation illustrated in FIG. 9, such conductive elements may connect to corresponding conductive elements (not shown) on PCBA 902 via apertures 914 in finger board 904. FIG. 10 shows a cross-sectional side view of such a connection in which a conductive stud 1002 is inserted in aperture 914 of finger board 904. Conductive fret 1004 is secured in a corresponding slot (not shown) on the top of finger board 904 and pressed into conductive stud 1002 as shown. In the depicted example, conductive stud 1002 has an extension that fits into a conductive via 1006 in PCBA 902. As will be appreciated, the configuration of each of these elements may be modified without departing from the scope of this disclosure.

As discussed above, implementations are contemplated in which the fret scanning system includes a microcontroller running dedicated firmware. As will be appreciated, such a design can result in a faster time-to-market as well as provide flexibility for including improvements or additional features. Algorithms for controlling operation of such an implementation will now be described with reference to the flowcharts of FIGS. 11-13.

Figure 11:
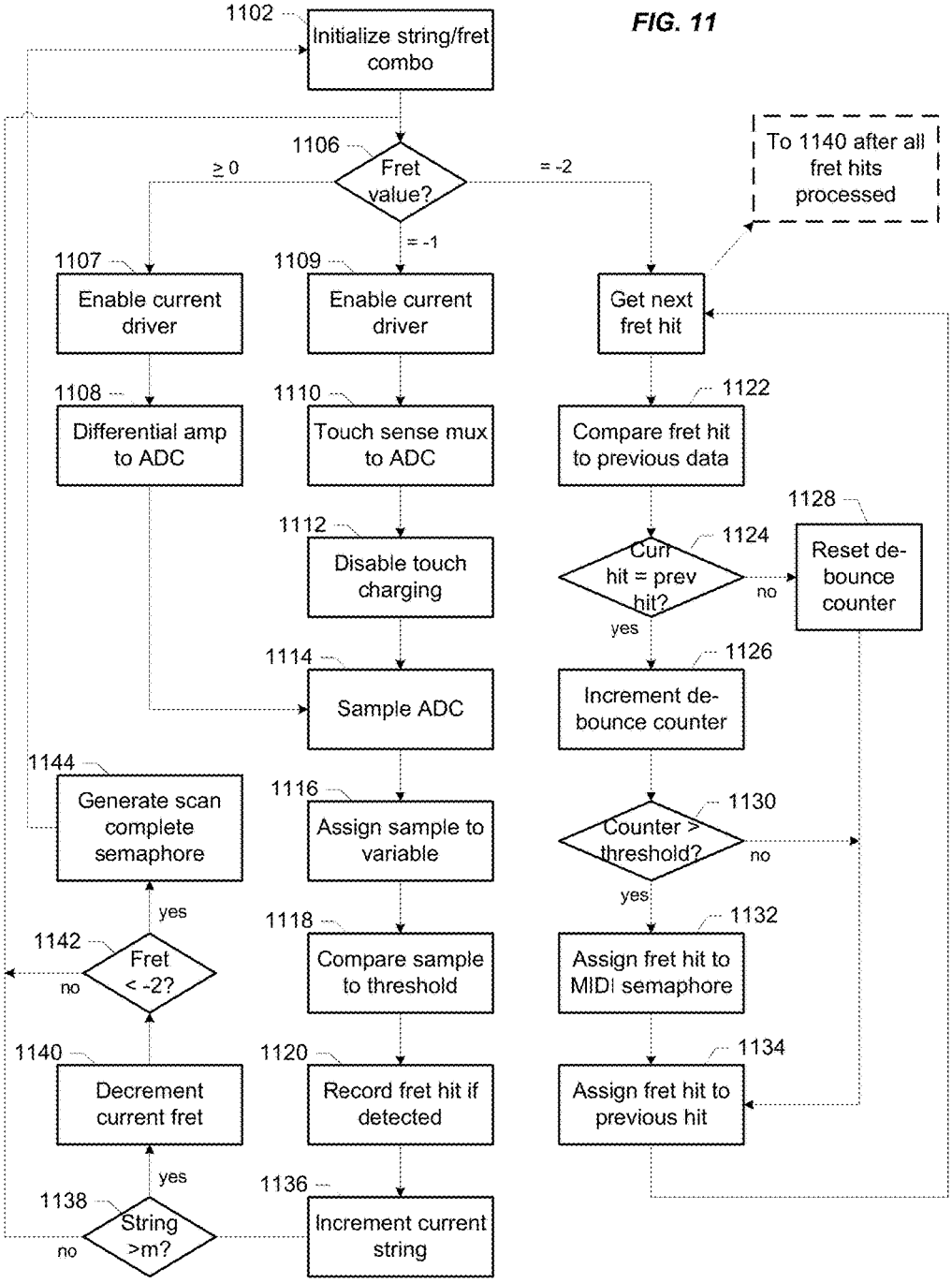
FIGS. 11-13 are flow diagrams illustrating various aspects of the generation and processing of fret scanning data.

FIG. 11 illustrates an example of the execution of a full board scan by a fret scanning system enabled by the present disclosure. According to a specific implementation, the depicted process is implemented in a loop that is precisely timed for improved frequency/jitter reduction. Note that in addition to iterations for each fret pair as represented by corresponding fret values, FIG. 11 includes two negative fret values that represent "fret periods" during which additional processing is performed such as, for example, a touch scan (e.g., as described above), and de-bouncing of fret hits (e.g., as described below).

Referring to FIG. 11, and assuming an m×n string/fret array as described above with reference to FIG. 6, a string/fret pair address (e.g., values for the current string and fret) is initialized to the first fret pair (e.g., fret n) and the first string (e.g., string 1) (1102). If the current fret value ≥0 (1106), the appropriate string driver is enabled (1107), and the corresponding differential multiplexer channel (e.g., 608) is enabled such that the output of differential amplifier (e.g., 610) is routed to the ADC (1108). If the current fret value=−1 (1106), the appropriate string current driver is enabled (1109), and the touch sense multiplexer is enabled such that the touch sense signals are routed to the ADC (1110). For the touch sensing case, touch charging is disabled prior to ADC sampling (1112).

Enabling the string current driver for the selected string for the implementation of FIG. 6 involves closing both corresponding switches 602 and 604 for fret scanning (1107), or just the corresponding switch 602 for touch sense charging (1109). According to a particular implementation, string current drive switching is performed early in the loop in order to minimize jitter which can generate audio band noise.

The input to the ADC is then sampled (1114). This typically takes several clock cycles and generates an interrupt when complete. The ADC sampled value is then assigned to the appropriate variable (1116). For example, if the fret value >0 (i.e., the currently selected fret is one of the n frets of the instrument), the sampled value is assigned to the variable fretSample. If the fret value=0 (i.e., fret 0 or the NULL fret is selected), the sampled valued is assigned to the variable nullSample. If the fret value=−1 (i.e., touch sensing is enabled), the sampled value is assigned to the variable touchSample.

The sampled value is then compared to the appropriate threshold (1118) to determine whether a fret hit has been detected (1120). If the current fret value >0, the variable fretSample is compared to the fret hit threshold, and a fret hit is registered for the string by recording the note, e.g., the fret value of the current fret, and the sampled value generated by the ADC (i.e., fretSample). Note that this is only done if a fret hit has not already been registered for the current string during the current full board scan. If the current fret value=−1, the variable touchSample is compared to the touch threshold. This is a "low going" threshold in that a hit is registered if the value of touchSample falls below the threshold. If a touch is detected, a fret hit is registered for the current string by recording a −1. Note again that this is only done if a fret hit has not already been registered for the current string during the current full board scan.

According to some implementations, fret hit thresholds may vary and even be dynamic. For example, different thresholds might be used depending on the conductivity of the string (e.g., the high and low E strings on a guitar may have significantly different conductivity) or the distance between the frets in a fret pair (e.g., the distance between fret n and fret n−1 is typically much small than the distance between fret 0 and fret 1). In another example, a fret hit threshold might vary depending on the number of strings that are simultaneously fretted at the same fret (see, for example, the difference in amplitude illustrated in FIGS. 8A and 8B).

If the current fret value=−2 (1106) (designating the fret hit collection period), each fret hit detected during the current full board scan is compared with the fret hit data recorded for the previous scan (1122). If a fret hit for the current scan is equal to the values recorded in the previous scan (1124), a de-bounce counter for that fret hit is incremented (1126). If not, the counter is reset (1128). If the counter exceeds a predefined and tunable threshold (1130), the fret hit is assigned to a musical instrument digital interface (MIDI) note semaphore (1132) which is ultimately communicated to the main processing loop for further processing as described below. The fret hit is then assigned to the previous fret hit for use with the next full board scan (1134). Note that once the de-bounce counter exceeds the threshold, the counter is frozen at that value until the fret hit changes from its previous value. This prevents the counter from overflowing and causing errors.

After 1120, the current string value is incremented (1136). If the current string value is greater than the final string (1138), e.g., >m, the current string value is reset to the first string and the current fret is decremented (1140). If decrementing the current fret results in the current fret value <−2, (1142), a scan complete semaphore is communicated to the main processing loop (1144), and the fret value is reset to its initial value (1102), e.g., fret n. Otherwise, the process returns to 1106.

Figure 12:
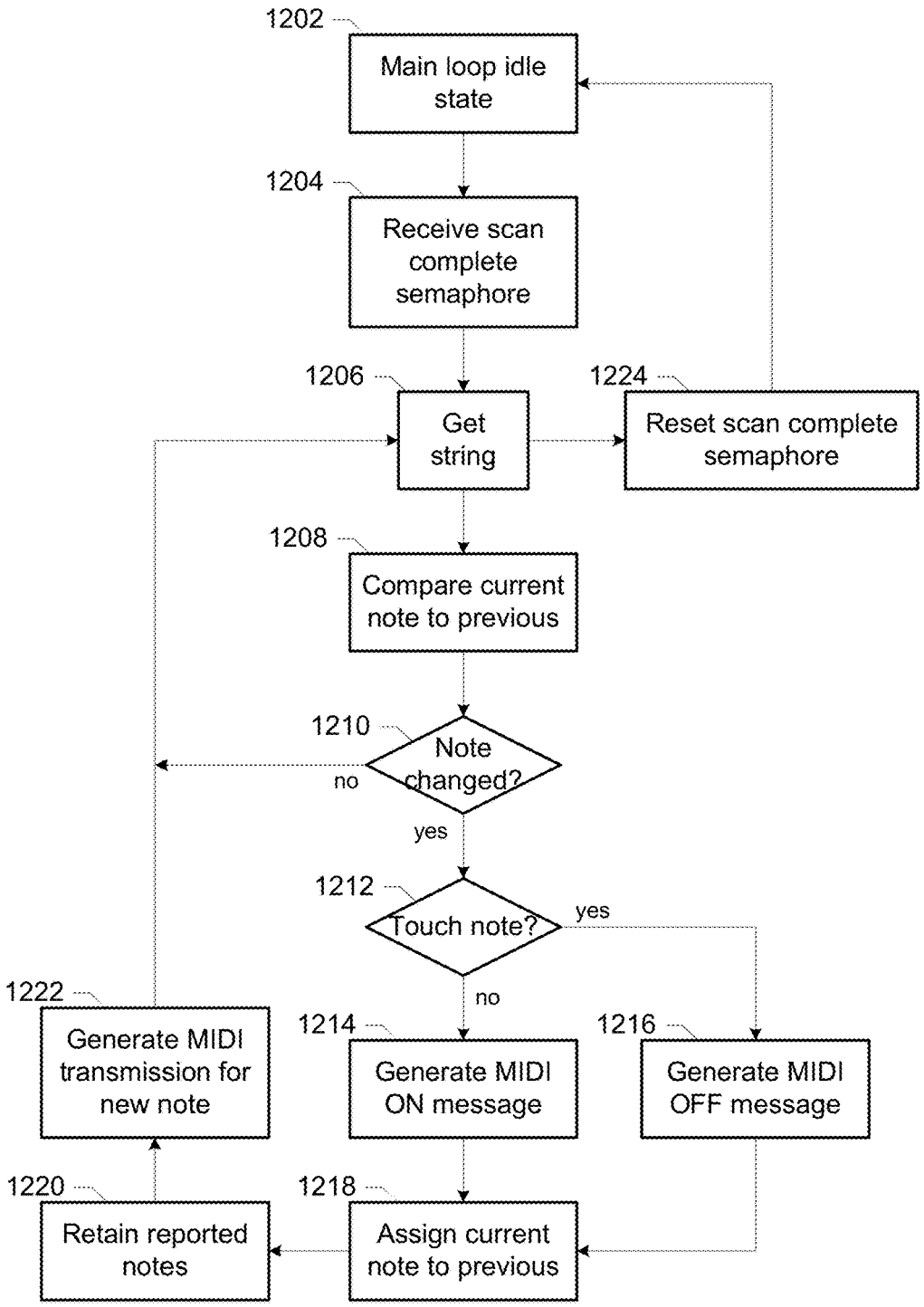

According to a particular implementation, the main processing loop receives and processes the results of the board scans and includes non-timing-critical functionality such as, for example, final commitment of fret hits to potential notes that are passed on to other systems, e.g., a synthesizer or a pitch detection system, for further processing. The main processing loop may be implemented in the firmware of a microcontroller as discussed above (e.g., as represented by post processing 612 of FIG. 6). Operation of a such a main processing loop is illustrated in FIG. 12.

The main processing loop waits in an idle state (1202) until a scan complete semaphore is received (1204) e.g., from the full board scan loop illustrated in FIG. 1. This might be achieved, for example, by repeated execution of a "while" statement until the condition is met. For each string on the instrument (1206), the current note (from the most recently completed scan) is compared to the previous note (from the previous scan) (1208). If the note has changed (1210) and is not a touch note (1212), e.g., fret value >0, a MIDI ON message is generated for the string that indicates the note, and uses the sampled value generated by the ADC as the velocity (1214).

If the note has changed (1210) and is a touch note (1212), e.g., fret value=−1, a MIDI OFF message is generated for the string with a note value or velocity of 0 to mute the string (1216). In either case, the current note for the string is then assigned to the previous note variable for use with the results of the next scan (1218).

All fretted notes, i.e., reported notes for fret values >0, are retained for use in a dithering correction algorithm (1220). A MIDI transmission is generated for any new notes (1222), and the scan complete semaphore is reset (1224).

As alluded to above, at least some of the processing associated with the main processing loop depicted in FIG. 12 may be done during "negative fret periods" that are designated by fret values having negative values. If more time is needed, this "negative" fret time could be increased with the fret scanning loop exiting immediately after updating the string/fret number. Such additional time may be used for main loop processing tasks, as well as to provide additional time for added features such as, for example, reading switches and potentiometers, etc.

Figure 13:
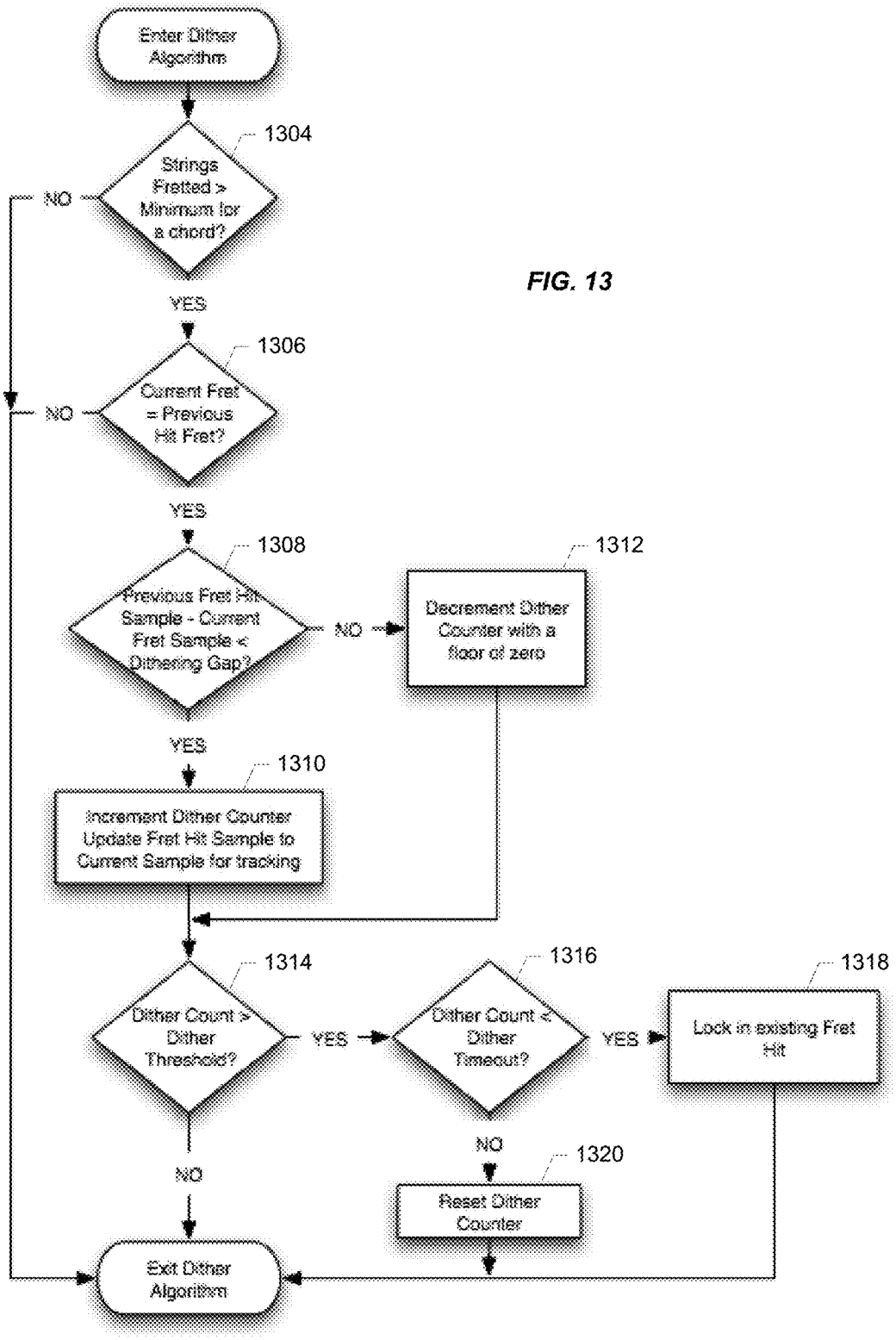

The present disclosure describes a variety of enhancements for use with fret scanning techniques that improve the robustness of fret hit detection. An example of one class of enhancements relating to the de-bouncing of fret hits is described above. Another class of enhancements relates to an issue that arises for the analog data generated by a fret scanning system in which the voltage level for the leading fret of a bridged fret pair diminishes slowly and eventually drops below the fret hit threshold. This often occurs in the case of complex, multi-string chords, particularly barre chords. If left uncorrected, the effect of this phenomenon is to drop the note reported for that string to the next flat note down the fretboard. This is referred to herein as "note dithering." According to some implementations, a dithering correction algorithm is provided to address this issue. FIG. 13 illustrates operation of one such algorithm. The depicted algorithm may be employed in conjunction with comparing reported fret data to a fret hit threshold as described above, for example, with reference to 1118 and 1120 of FIG. 11 (for fret values >0).

When a sampled ADC value exceeds the fret hit threshold, two conditions are checked to determine whether to enter the dithering correction loop. First, the number of simultaneously fretted strings (e.g., as determined in the main processing loop from the last completed full board scan) must be greater than a tunable parameter, e.g., two or three strings (1304). Second, the current sampled ADC value must correspond to a string and fret combination for which a fret hit was recorded in the previous full board scan (1306). If these conditions are met, the dithering correction loop is entered.

If the sampled value for the fret hit has decreased relative to the sampled value for the previous fret hit by less than another tunable parameter referred to as the "dithering gap" (1308), a dither counter is incremented and the stored sampled value for the fret hit is updated to the current sampled value for use in the next scan (1310). Otherwise, the dither counter is decremented with a floor of zero (1312). If the dither count (i.e., the number of consecutive scans showing a small downward trend in sample amplitude) exceeds a "dither threshold" count (another tunable parameter) (1314) and has not yet reached a "dither timeout" count (another tunable parameter) (1316), a "locking" condition is entered (1318) in which the threshold comparison for the sampled value is bypassed in the next scan and the note for the current string/fret combination continues to be reported as a valid fret hit even if the sampled ADC value trickles below the fret hit threshold.

Once in this locked state, if the sampled ADC value does not recover before reaching the "dither timeout" count, the dither counter is reset and the lock is released (1320). This allows the flat note to become the valid fret hit in the next scan. However, in practice, this generally will only occur on an actual intended slow slide down to the flat note by the instrument's player. Proper tuning of the three parameters described above will enable accurate note detection across a wide range of playing styles.

According to some implementations, algorithms for correcting note dithering may be based on or enhanced by observation of the behavior of the sampled ADC value for a trailing fret. That is, as illustrated in FIGS. 8A and 8B, the trailing fret (e.g., fret x−1) has a much higher pulse amplitude than the actual fret being depressed by the musician (e.g., fret x) due to the voltage dividing effect experienced by the selected fret. Typically, the greater sampled value for a trailing fret will be ignored if a fret hit was detected for the leading fret. However, instead of ignoring the sampled value for the trailing fret, it can be compared to a threshold that is higher than the fret hit threshold and, where it exceeds the higher threshold, can be identified as a trailing fret, thereby confirming the detection of the fret hit for the leading fret.

Techniques for de-bouncing fret hits and for correcting note dithering as described herein may be used separately or in combination to improve the robustness of fret hit detection and reduce the likelihood that a fret scanning system registers or reports erroneous notes. Additional techniques may be used in conjunction with one or both of these classes of techniques to further improve fret hit detection and note reporting.

For example, de-bouncing may be applied differently for different types of note transitions. That is, in a symmetrical case, the de-bounce threshold is the same number of consecutive scans for any note transition possible on a given string. These transitions include Open String->Fret, Fret->Fret, and Fret->Open String. But since we have information on the note registered for each string in the previous scan, we can take an asymmetrical approach in which we apply different thresholds for the different types of transitions. For example, the case of an apparent Fret->Fret transition in which a note appears to have transitioned exactly one half tone lower (i.e., one fret) resembles the kind of error that note dithering causes. So, in this case (and possibly in addition to the counter-dithering algorithm described above), a more stringent approach to de-bounce can be applied. That is, the de-bounce threshold can be set higher (e.g., 10 scans instead of 5) as a countermeasure to passing along an erroneous note when dithering is occurring. As in the case of the dithering algorithm, this more stringent de-bounce qualifier could be conditional on a minimum number of simultaneous fretted strings and other known triggers for the dithering condition so as to not detract from the response/performance of the system when dithering is unlikely to be occurring.

According to some implementations, a fret scanning system can generate confidence scores for each fret hit that may be included with the MIDI messages that are transmitted to external systems such as, for example, a pitch detection system. For example, when detecting fret hits, multiple threshold levels could be used to assign a confidence score to each fret hit. This information could be provided to the pitch detection algorithm which could intervene before an erroneous note would actually get committed. For instance, if a voltage level as measured by the ADC was significantly larger than the minimum threshold for a hit, and perhaps higher than a second level threshold, that note would be transmitted to the pitch detection algorithm with a high confidence, where borderline threshold crossings would be sent with lower confidence. Depending on the received confidence level, the pitch detection could hold off committing a note pending more stringent pitch detection certainty. The response of the system would be lower for that moment in time, but at least an erroneous note would not get played.

Figure 14:
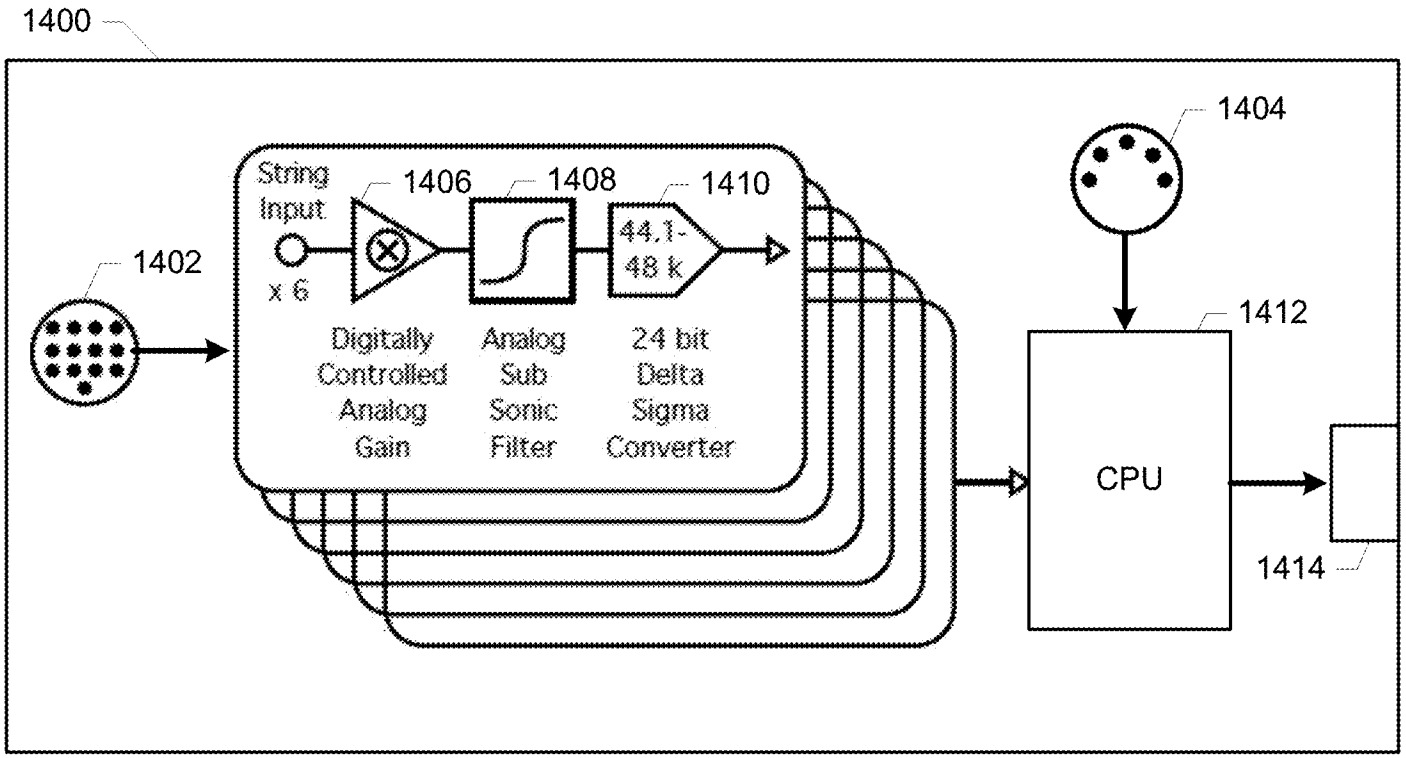
FIG. 14 is a simplified diagram of a device configured to detect the pitch associated with the strings of a string instrument.

As mentioned above, the output of a fret scanning system may be used by a pitch detection algorithm to more quickly determine pitch than is typically possible using the output of a pickup alone. One example of a pitch detection algorithm enabled by the present disclosure may be implemented in the StringPort from Keith McMillen Instruments, an implementation of which is described in U.S. Pat. No. 8,581,086 incorporated by reference above. The StringPort provides real-time musical pitch information derived from the live audio input of each string of an instrument. FIG. 14 shows a simplified diagram of a StringPort.

StringPort 1400 receives polyphonic string audio through an industry standard Din 13 connector 1402. The audio signals are generated by a pickup system (not shown) on the stringed instrument that has one or more dedicated transducers for each string such as, for example, described above with reference to FIGS. 1-4. It will be understood that a variety of suitable pickup systems may be employed. In the depicted example, connector 1402 transfers six strings of audio. However, it should be noted that embodiments are contemplated in which fewer or more string signals may be handled. Din 13 connector 102 may also supply analog control signals such as a volume potentiometer and select switches from the instrument through the cable. Fret scanning data is provided to StringPort 1400 via MIDI connector 1404.

StringPort 1400 samples the polyphonic string signals with high quality Delta Sigma ADCs. Each audio signal passes through a digitally controlled gain stage 1406, is filtered 1408, and then converted to 24-bit data by ADC 1410 at either a 44.1 KHz or 48 kHz sample rate. A central processing unit (CPU) 1412 or the equivalent (e.g., any type of conventional processor or controller, custom integrated circuits, etc.) extracts and formats the serial digital audio streams from the ADCs and transmits them to an interface 1414 which may be, for example, a wired interface (e.g., a Universal Serial Bus (USB) connector) or a wireless interface (e.g., a Bluetooth transceiver). The output audio signals are then transmitted to a connected system, e.g., a synthesizer, a computer, etc. CPU 1412 is also configured to perform a pitch detection algorithm that employs string audio samples and fret scanning data to determine the pitch associated with each string. A specific implementation of such a pitch detection algorithm is described below with reference to FIGS. 15-17.

Given that a note performance on a stringed instrument typically includes a quick attack (actuated by the plucking or picking of a string) followed by the residual free vibration of the string, it is desirable that a pitch detection algorithm both responds quickly to the actuation with an accurate estimate of the note performed, and also tracks the free vibration of the string. The former of these two tasks is referred to herein as trigger pitch detection; the latter as continuous pitch analysis.

According to a particular class of implementations, the onset of a note performance for each string on a stringed instrument is determined by a trigger detection algorithm that provides a triggers to the overall pitch detection algorithm to indicate that a trigger pitch should be determined. According to some implementations, the triggers are generated from the string signals using an event capture and classification functionality that employs a time-domain analysis that marks each inflection point (e.g., local maxima and minima) in a string signal waveform, and classifies the events using a trained neural net that can accurately determine when an event begins and the event type. For further information regarding this event classification technique, please refer to U.S. Pat. No. 8,581,086, incorporated herein by reference above.

The overall pitch detection algorithm employs the continuous tracking of pitch, as well as information from a fret scanning system that provides an estimate of the current fret depressed on the neck of the stringed instrument. The overall pitch detection algorithm also receives sampling messages upon which it reports the current continuous pitch estimate as a discrete message or as a signal. It should be noted that, while the pitch detection algorithms described herein may be employed with pickups and fret scanning systems enabled by the present disclosure, implementations are contemplated in which other types of pickups and fret scanning systems may be used.

The overall pitch detection algorithm employs a hybrid model of computation involving both synchronous discrete time signals as well as asynchronous discrete events. The discrete time signals employ fixed-sized sample blocks, the size of which can be set globally. The processing of a block of samples from each input (each representing a string) produces a block of samples for each output. This portion of the overall pitch detection algorithm is referred to herein as the digital signal processing (DSP) process.

The asynchronous part of the overall algorithm involves the reception of message events that schedule the execution of event-handling routines. The order of execution of these routines is determined by an event scheduler. This portion of the overall pitch detection algorithm is referred to herein as the message handling process. It should be noted that, despite the hybrid model described herein, the synchronous and asynchronous parts of the algorithm could be integrated on a homogeneous platform such as, for example, Max/MSP, a visual programming language for music and multimedia developed and maintained by Cycling '74 of San Francisco, Calif.

The overall pitch detection algorithm aggregates blocks of input samples for a given instrument string into a buffer called an input window. The input samples are the digital representations of the state of the corresponding instrument string, e.g., the 24-bit data generated by ADC 1410 of the StringPort of FIG. 14. The size of the input window may relate to the sizes of data blocks consumed by the various analyses performed in the pitch detection routines. If the size of the input window is larger than that of the sample block, the input window may include samples from one or more blocks. As sample blocks are consumed by the DSP process, the blocks in the window are shifted back by the size of the block and the first block of the window is filled with a new block. In effect, the input window is a fixed sized queue of samples that are queued for each step of the DSP process. Some of the routines that run in the DSP process are not necessarily run every DSP step. Instead, a hop size might be defined in terms of a number of samples and such a routine would be run each time a hop size of samples has been shifted into the input window.

Figure 15:
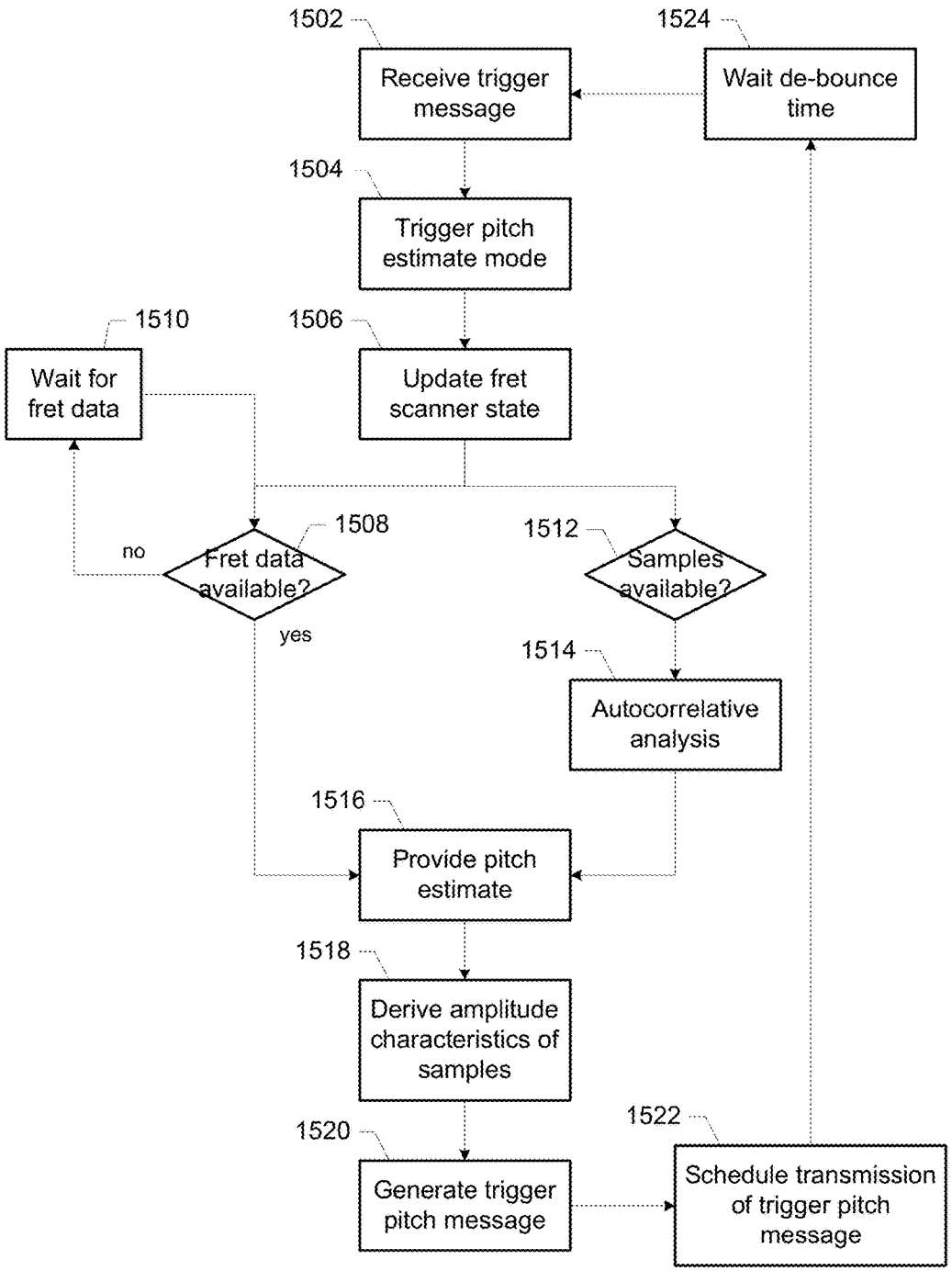
FIGS. 15-17 are flow diagrams illustrating various aspects of pitch detection.

According to a specific implementation illustrated in FIG. 15, a trigger pitch detection algorithm operates as follows. Upon receipt of a trigger message from the trigger detection algorithm indicating the onset of a note performance (1502), the trigger pitch detection algorithm enters an operational mode indicating that a trigger pitch estimate is being sought by the DSP process (1504). The state of the fret scanner, including an estimate of the fret that has been depressed and possibly including reliability information, is updated (1506).

The DSP process may employ two different methods to estimate the trigger pitch. These methods can also be combined in several ways; the fret method which uses information from a fret scanner, and autocorrelative analysis. Typically, the information from a fret scanner provides a good estimate of the current fret, and thus the current pitch that would result from actuating the string, sufficiently prior to the reception of the trigger message. However, if the fret information is not currently available or reliable (1508), the trigger pitch detection algorithm waits until the analysis hop when the fret information is available/reliable (1510). By contrast, autocorrelative analysis (1514) waits for a significant segment of the samples generated by the onset of the note performance to appear in the input window (1512). Thus, when the fret information can be used reliably, it makes sense to do so, with autocorrelative analysis being performed as a fallback.

Once the fret information is determined to be available/reliable, and/or an autocorrelative analysis provides a pitch (1516), further information is obtained about the amplitude characteristics of samples in the input window (1518). A trigger pitch message is generated that includes the estimated pitch along with other characteristics of the input window (1520). This trigger pitch message is scheduled for asynchronous transmission as an event (1522). The trigger pitch detection algorithm then enters a mode in which it waits the duration of a specified de-bounce time before accepting further trigger messages (1524).

Figure 16:
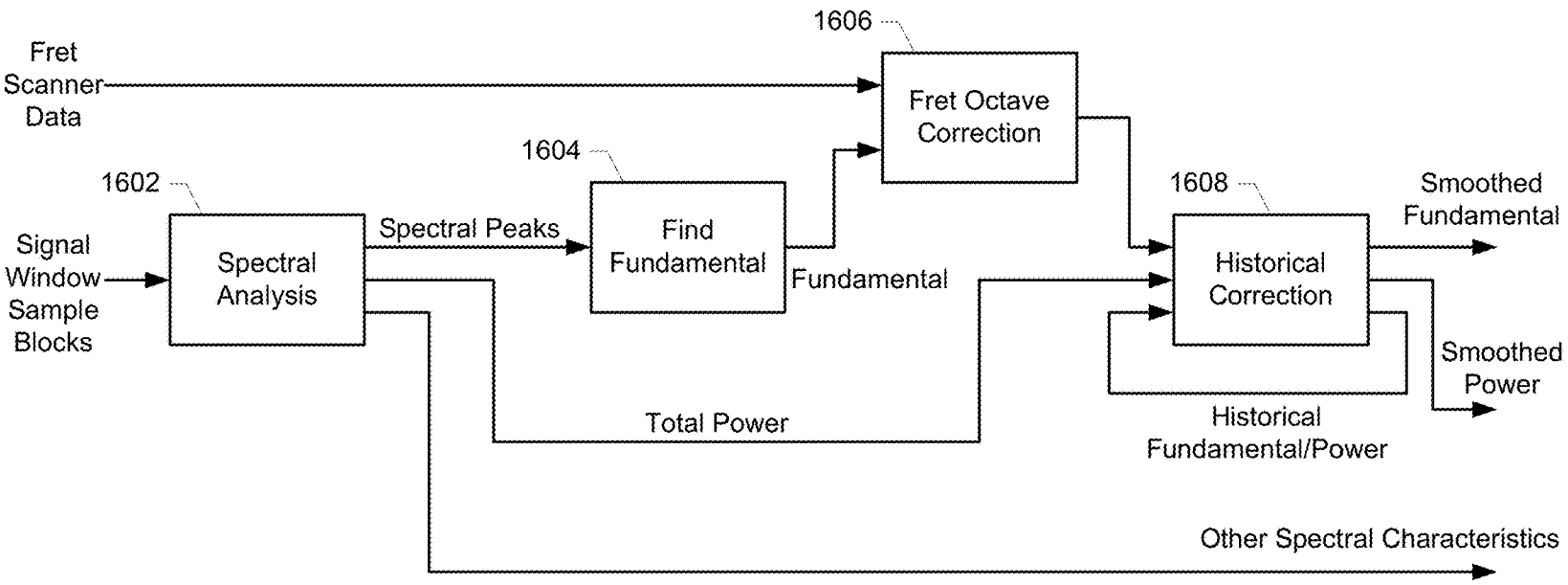

A particular implementation of the overall algorithm for continuous pitch estimation is depicted in FIG. 16. The spectral analysis portion of the depicted algorithm is depicted in more detail in FIG. 17. Two significant inputs to the algorithm are shown as the input window of sample blocks, and the fret scanner data. However, it will be understood that there are other states and parameters that may be provided that help to determine the behavior of the algorithm.

When identifying the fundamental frequency of a signal using spectral analysis it may be difficult to identify the correct octave. A spectral sieve can identify harmonics that are related as whole number multiples, i.e., the fundamental or 1st harmonic, the 2nd harmonic (2× fundamental), the 3rd harmonic (3× fundamental), etc., but a rapid decision by the sieve can produce results identifying other harmonics as the fundamental.

Referring now to FIG. 16, spectral analysis (1602) determines a set of spectral peaks from the input window along with other information such as power and the statistics of the distribution. From the spectral peaks, an estimate is made of the fundamental frequency that would have the given peaks as its overtone series (1604). The initial fundamental estimate may be prone sporadically to identification of an incorrect fundamental, e.g., one that is a small number of octaves higher than the actual note being performed. Knowing the string length (as represented by the fret scanner data) limits the options for the spectral analysis, and may be used to correct this error. That is, the fret scanner data is used to check that the fundamental is in proximity to the note being fretted if the instrument were in tune and the string was ringing freely (1606). If it is not in proximity to the fretted note, but is instead in proximity to one of the next several higher octaves, the octave difference is corrected. This allows for more rapid response relative to spectral analysis alone, i.e., identifying any portion of the harmonic series combined with knowing the correct octave will produce an accurate and rapid identification of the fundamental frequency. Note that if the string is bent, or other forms of vibrato and distortion are applied to vary the pitch, the continuous pitch generally deviates from the apparent fretted note, although very rarely by more than a fraction of an octave without the fret state changing to reflect the performance. Given that the estimate is being derived from the current input window, historical correction is applied to remove outliers and filter out small variations (1608).

If spectral analysis 1602 fails to identify a harmonic series within a programmable time, fret octave correction 1606 will send the pitch estimate derived from the fretted note to historical correction 1608. Historical correction 1608 looks for previous pitches and trends to smooth over brief inconsistencies in reported pitch before sending the pitch estimate out as a smoothed fundamental. Awareness of total power in historical correction 1608 also provides information about the string. Changes in pitch are often associated with changes in the string's power. Also the amount of smoothing in historical correction 1608 can be increased as the power of the string lessens and noise may start to cause variations in pitch data. Finally there is known small signal level where the pitch is not considered reliable at which point historical correction 1608 holds the last known reliable pitch estimate.

Figure 17:
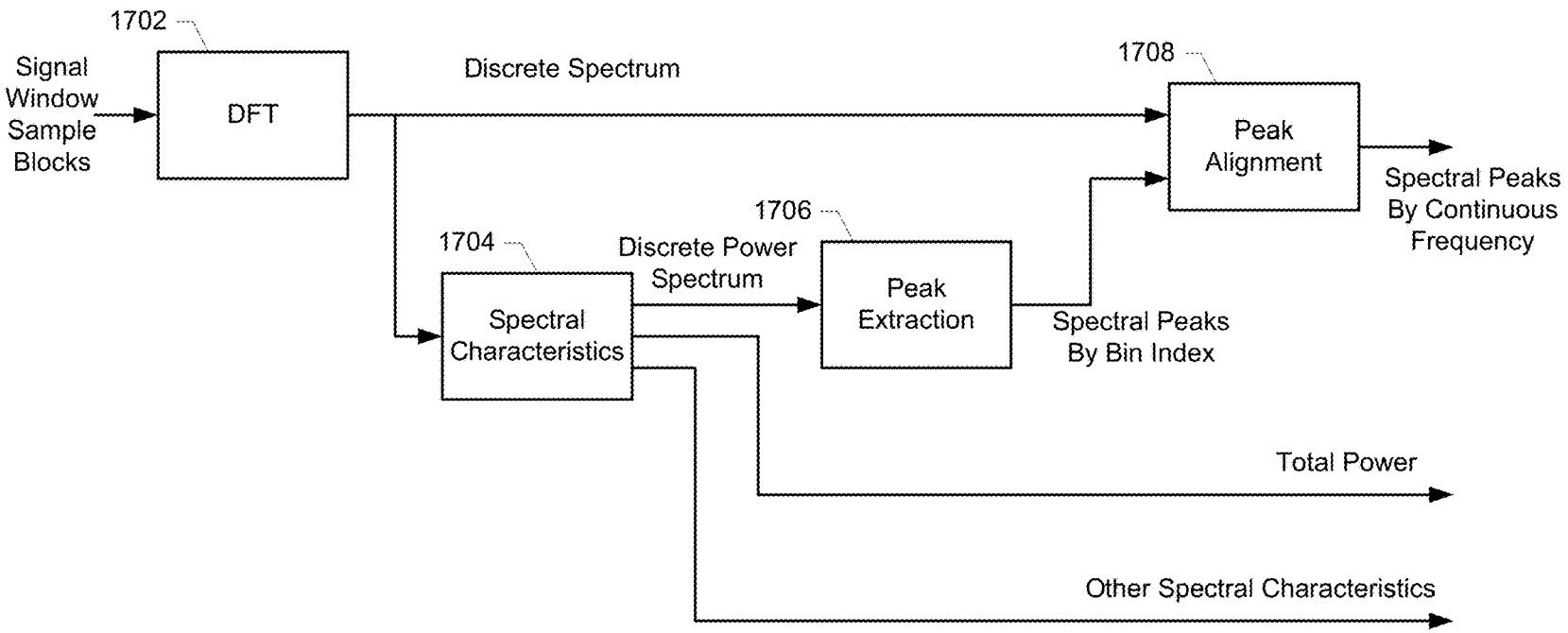

A more detailed illustration of spectral analysis 1602 is shown in FIG. 17. The spectral analysis begins with the computation of a discrete spectrum from the input window (1702). This spectrum, containing both amplitude and phase characteristics, is then reduced to a power spectral density, and various spectral characteristics such as total power and spectral centroid are derived (1704). During this process several techniques are used to filter and augment the power spectral density. Using the power spectral density, a series of peaks representing overtones in the harmonic series of the pitch are extracted (1706) and identified by the discrete index at which they appear in the power spectral density. Techniques involving the original discrete spectrum are used to give these peaks more accurate continuous values (1708). This series of continuous peaks can then be used in the manner described above.

During the beginning of a note performance, when a note is picked or plucked, the pitch information from the continuous pitch analysis can be distorted and ambiguous because of the transients from the actuation of the string and/or an insufficient number of periods of the waveform to get a clear estimate. It is for this reason that the trigger pitch estimate is produced at the beginning of a note performance, while the continuous pitch becomes accurate at some point after the trigger is detected. The continuous pitch analysis also typically becomes inaccurate when the amplitude of the vibration of the string drops below a level significant enough to perform the analysis amidst the noise. And as will be appreciated, when the string is not vibrating at all there is no meaningful notion of continuous pitch.

According to a particular implementation, a state machine and gating mechanism are used to track the different conditions under which pitch is reported. After a trigger is detected, pitch is reported as the trigger pitch rather than the continuous pitch coming from analysis. After a delay, and if the continuous pitch data is consistent, pitch is reported from the continuous pitch analysis. When the amplitude level falls below a threshold and the variation in continuous pitch increases above a certain amount (e.g., as during the end of a note decay), the last good pitch is simply held and reported. Finally, when amplitude falls below a lower threshold, indicating the note performance has ended, no pitch is no longer reported. It should be noted that, although these modes are described in a particular, prototypical sequence, they could appear for various reasons in other sequences.

As discussed above, a fret scanning technique may be used in conjunction with a pitch analyzer that uses the pitch estimate generated from the fret data to quickly determine pitch by examining the harmonics of a plucked note. This enables determination of pitch much more quickly than using a pitch analyzer alone, e.g., as quickly as 5 to 15 milliseconds depending on the string's pitch. Even if a musician frets a note, plucks the string, and then bends the string, continuously changing its pitch, such an approach can remain effective.

Figure 18B:
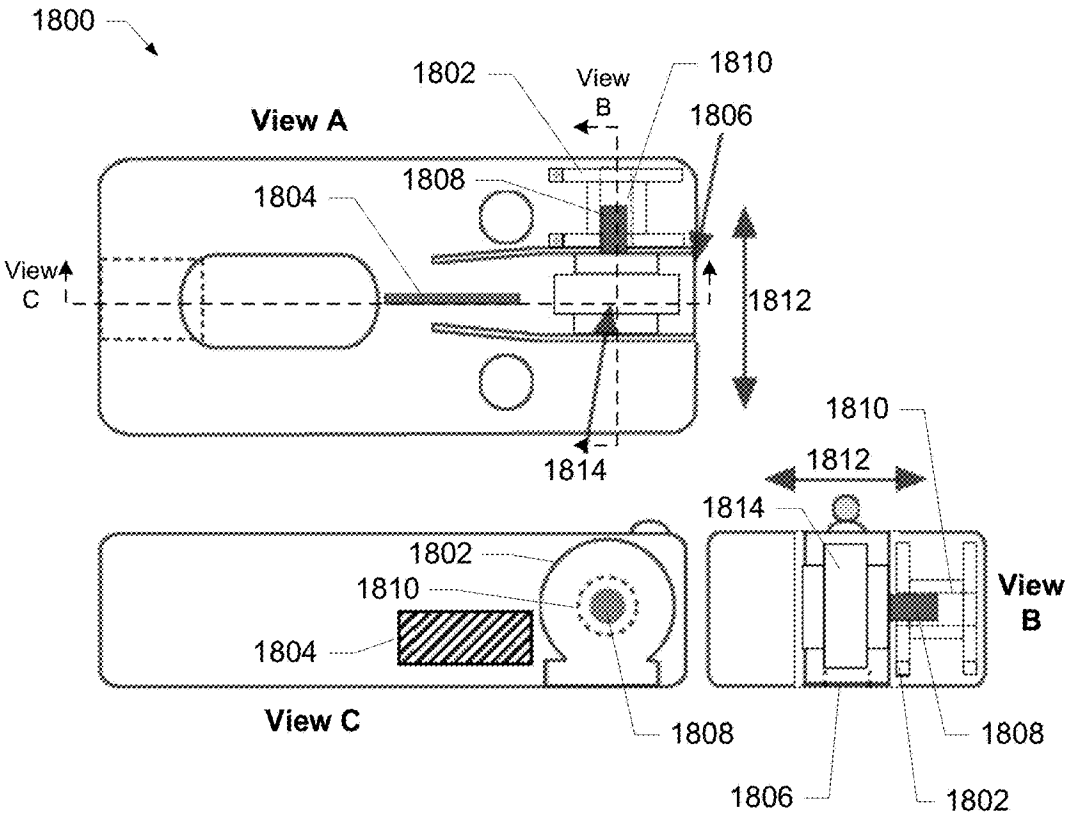
FIG. 18B includes simplified representations of various views of a particular implementation of a pickup configured to detect string displacement.
Figure 18A:
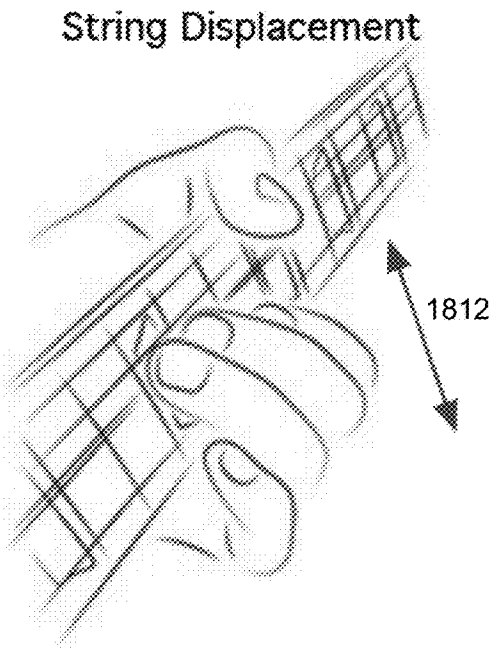
FIG. 18A is an illustration of string displacement relative to a fingerboard of a stringed instrument.

However there is a common guitar technique in which a musician pre-bends the string parallel to the fingerboard before plucking as illustrated in FIG. 18A. Musically, this allows the player to bend a string flat by releasing the sidewise pre-bend. Unfortunately, when using fret data to determine an initial pitch estimate, this guitar technique can result in undesirable audible artifacts in that there is a short time when the difference between the pitch determined by the pitch recognition system and the fretted pitch is briefly audible as a lower pitch that jumps up to the higher pitch of the pre-bent string.

According to a particular class of implementations, a string displacement sensor is provided that senses the extent of the sideways bend of the string before the string is plucked. The sensor employs an inductor the inductance of which changes in a manner that is representative of the bend of the string. Three views (Views A, B, and C) of a particular implementation of such a string displacement sensor are illustrated in FIG. 18B.

In the depicted example, a coil 1802 is integrated with a saddle component 1800 that also serves as a pickup. The pickup functionality may be implemented using a piezoelectric element 1804 in a manner similar to saddle component 100 of FIG. 1. However, it should be noted that alternate implementations are contemplated. For example, the piezoelectric element could be a bimorph device, or the pickup functionality could be implemented using some other technology or in some other device. Coil 1802 is fixed in saddle component 1800 in the part of saddle component 1800 adjacent tone arm 1806. A core component 1808 (e.g., ferrite or other suitable metal) extends from tone arm 1806 and into a core cavity 1810 of coil 1802. Alternatively, the coil could be integrated with the tone arm and the core component extend from the adjacent part of the body.

As the string associated with saddle component 1800 is bent in either direction (as illustrated by arrow 1812), the insertion depth of core component 1808 in coil 1802 changes from its median position. And as the proportion of air to metal in the core of coil 1802 changes, its inductance changes correspondingly. Coil 1802 may be implemented, for example, using about 430 turns of 0.55ϕ2UEW enameled copper wire.

Figure 19A:
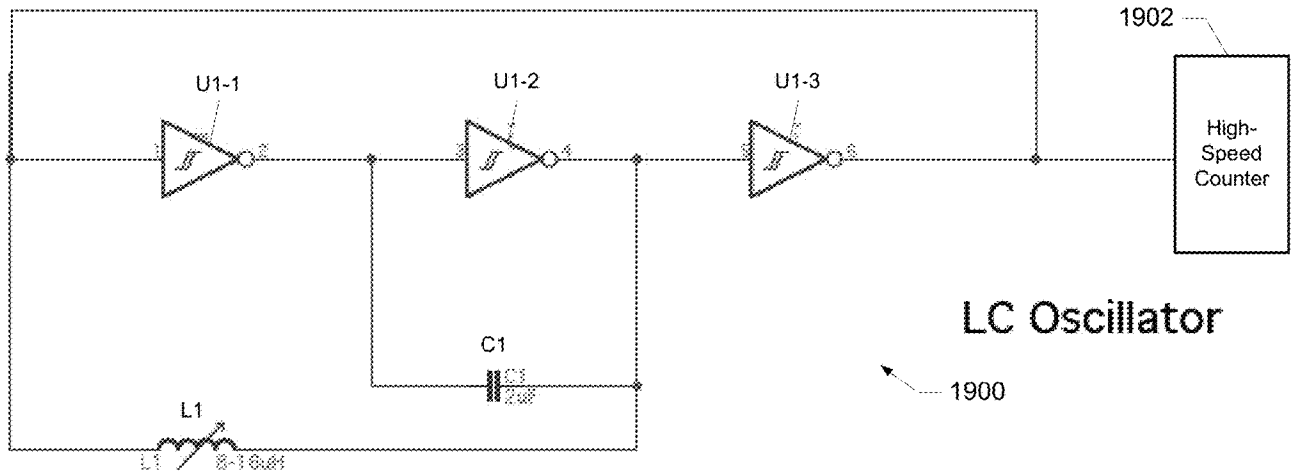
FIG. 19A is a simplified schematic of an oscillator circuit for use with the pickup of FIG. 18B.
Figure 19B:
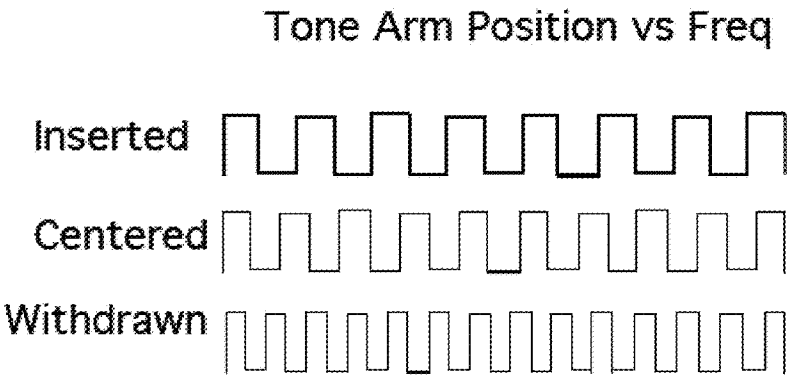
FIG. 19B is a simplified illustration of waveforms generated by the circuit of FIG. 19A.

According to a particular implementation, the variable inductance coil is part of an LC oscillator 1900 as depicted in the circuit diagram of FIG. 19A. The depicted oscillator is implemented using 3 Schmitt triggers (U1-1, U1-2, and U1-3), variable inductor L1 (which represents the coil), and capacitor C1. The Schmitt triggers may be, for example, part number SN74AHC14DR from Texas Instruments. The range of inductance for L1 is about 8-16 uH and the capacitance of C1 is about 2 uF. Changes in the inductance of L1 are reflected in corresponding changes in the oscillation frequency of the LC oscillator as captured by high-speed counter 1902. Examples of oscillator waveforms for three different positions of the inductor coil core (inserted, centered, and withdrawn) are shown in FIG. 19B. The changes in frequency have been exaggerated for illustrative purposes. Using a circuit like oscillator 1900, the change in inductance of a coil due to a sideways string bend has been measured to be on the order of about 0.03%. At least some of the components of oscillator 1900 might be mounted, for example, on an associated circuit board (e.g., PCBA 406 of FIG. 4).

The bend information generated by saddle component 1800 can be used to inform a pitch detection system (e.g., as described herein) about a string's status in multiple ways. For example, it can be used to indicate a bend "go/no-go" condition that can be used to inhibit a report of the string status based solely on the fret data. That is, when a string is bent, the fret data would otherwise report a value that would be flat relative to the actual state of the bent string. So, instead of using the fret data from a fret scanning system to generate a pitch estimate, the pitch detection system might wait until the actual frequency can be determined by other means, e.g., using continuous pitch analysis based on a pickup signal. In another example, bend information can be used to provide a variable degree of positive offset (based on the degree of bend) to the value reported by the fret scanning system. That is, the pitch estimate derived from the fret data would modified using the bend information to account for the increased tension on the string. In some cases, such a modified estimate could be used instead of the pitch estimate derived from the string signal, e.g., where the part of the overall pitch detection algorithm that employs continuous pitch analysis doesn't resolve to a reliable value quickly enough.

The vertical position of the saddle component's tone arm (i.e., in the axis perpendicular to the face of the instrument) can change as a result of the tension of the instrument string. This deflection is potentially problematic with regard to the alignment of the core extending from the tone arm into the coil. Therefore, according to some implementations and as shown in FIG. 18B, core component 1808 is not rigidly attached to tone arm 1806 but is instead secured using a magnet 1814 that is integrated with tone arm 1806. This allows for core component 1808 to move relative to tone arm 1806 and to re-center itself relative to core cavity 1810 in response to vertical displacement of the tone arm.

It should be noted that any computer program instructions or code with which functionality described herein may be implemented may correspond to any of a wide variety of programming languages, software tools, data formats, or codecs, may be stored in any type of volatile or nonvolatile, non-transitory computer-readable storage medium or memory device, and may be executed according to a variety of computing models without departing from the scope of the invention. For some implementations, such instructions or code may be implemented in software or firmware associated with embedded devices such as, for example, processors, microcontrollers, or the like. Implementations are also contemplated in which at least some functionality may be implemented using programmable devices, application-specific integrated circuits, or the like. Reference to specific modes of implementing certain functionality should therefore not be used to limit the scope of this disclosure.

It will be understood by those skilled in the art that changes in the form and details of the implementations described herein may be made without departing from the scope of this disclosure. For example, it should be noted that at least some of the techniques described herein may be employed with instruments that do not have frets. That is, for example, fretting data representing fretting hand positions or string lengths (rather than fret hits as described above) could be reported for fretless instruments for use by pitch detection systems as described herein with reference to FIGS. 16 and 17. In another example, a fretless instrument could use pickups and related signal processing techniques as described herein with reference to FIGS. 1-3, 18, and 19. In addition, in some examples described above, reference is made to a guitar as the stringed instrument. However, those of skill in the art would understand that the various techniques, devices, and systems described herein may be applied to a wide variety of stringed instruments. The scope of the present disclosure should therefore not be limited by reference to the specific implementations and examples described herein.

Finally, although various advantages, aspects, and objects have been described with reference to various implementations, the scope of this disclosure should not be limited by reference to such advantages, aspects, and objects. Rather, the scope of this disclosure should be determined with reference to the appended claims.

What is claimed is:

1. A computer program product, comprising one or more non-transitory computer-readable media having computer program instructions stored therein, the computer program instructions being configured such that, when executed by one or more processors, the computer program instructions cause the one or more processors to:

receive fretting data representing fretting hand positions for strings of a stringed instrument;

receive a bend signal for a first string of the stringed instrument, the bend signal representing an inductance that varies with bending of the first string and indicating that the first string is bent parallel to a top surface of the stringed instrument, the bend signal being generated independently of the fretting data;

determine a fundamental frequency estimate for the first string using the fretting data for the first string; and modify the fundamental frequency estimate for the first string using the bend signal.

2. The computer program product of claim 1, wherein the computer program instructions are configured to cause the one or more processors to modify the fundamental frequency estimate for the first string by:

determining a displacement of the first string based on the bend signal; and modifying the fundamental frequency estimate for the first string based on the displacement of the first string.

3. The computer program product of claim 1, wherein the computer program instructions are further configured to cause the one or more processors to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string;

initially report a pitch estimate for the second string based on the second fundamental frequency estimate for the second string;

after a delay, report the pitch estimate for the second string based on the first fundamental frequency estimate for the second string;

when an amplitude of the string data for the second string falls below a first threshold, lock a current value of the pitch estimate for the second string; and when the amplitude of the string data for the second string falls below a second threshold, terminate reporting of the pitch estimate for the second string.

4. The computer program product of claim 1, wherein the computer program instructions are further configured to cause the one or more processors to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string; and where determination of the first fundamental frequency estimate for the second string takes longer than a programmable period of time, report a pitch estimate for the second string based on the second fundamental frequency estimate for the second string.

5. The computer program product of claim 1, wherein the computer program instructions are further configured to cause the one or more processors to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string; and where a signal level associated with the second string is below a threshold, report a pitch estimate for the second string based on the second fundamental frequency estimate for the second string.

6. The computer program product of claim 1, wherein the computer program instructions are further configured to cause the one or more processors to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string;

generate a plurality of successive pitch estimates for the second string based on successive values of the first fundamental frequency estimate or the second fundamental frequency estimate; and generate a smoothed pitch estimate for the second string using the plurality of pitch estimates.

7. The computer program product of claim 6, wherein the computer program instructions are further configured to cause the one or more processors to determine a power of the second string, and to vary a number of the successive pitch estimates used to generate the smoothed pitch estimate based on the power of the second string.

8. The computer program product of claim 1, wherein the computer program instructions are configured to cause the one or more processors to:

receive string data representing vibrations of the strings of the stringed instrument;

determining a discrete spectrum using a range of the string data for a second string of the stringed instrument;

determining a power spectral density for the range of the string data using the discrete spectrum;

extracting a plurality of harmonics from the power spectral density; and identifying one of the harmonics as a fundamental frequency estimate for the second string.

9. A device, comprising:

memory;

one or more interfaces configured to receive fretting data representing fretting hand positions for strings of a stringed instrument, the one or more interfaces also being configured to receive a bend signal for a first string of the stringed instrument, the bend signal representing an inductance that varies with bending of the first string and indicating that the first string is bent parallel to a top surface of the stringed instrument, the bend signal being generated independently of the fretting data; and one or more processors configured in conjunction with the memory to:

determine a fundamental frequency estimate for the first string using the fretting data for the first string; and modify the fundamental frequency estimate for the first string using the bend signal.

10. The device of claim 9, wherein the one or more processors are configured to modify the fundamental frequency estimate for the first string by:

determining a displacement of the first string based on the bend signal; and modifying the fundamental frequency estimate for the first string based on the displacement of the first string.

11. The device of claim 9, wherein the one or more processors are further configured to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string;

initially report a pitch estimate for the second string based on the second fundamental frequency estimate for the second string;

after a delay, report the pitch estimate for the second string based on the first fundamental frequency estimate for the second string;

when an amplitude of the string data for the second string falls below a first threshold, lock a current value of the pitch estimate for the second string; and when the amplitude of the string data for the second string falls below a second threshold, terminate reporting of the pitch estimate for the second string.

12. The device of claim 9, wherein the one or more processors are further configured to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string; and where determination of the first fundamental frequency estimate for the second string takes longer than a programmable period of time, report a pitch estimate for the second string based on the second fundamental frequency estimate for the second string.

13. The device of claim 9, wherein the one or more processors are further configured to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string; and where a signal level associated with the second string is below a threshold, report a pitch estimate for the second string based on the second fundamental frequency estimate for the second string.

14. The device of claim 9, wherein the one or more processors are further configured to:

receive string data representing vibrations of the strings of the stringed instrument;

determine a first fundamental frequency estimate for a second string of the stringed instrument by performing a spectral analysis of the string data for the second string;

determine a second fundamental frequency estimate for the second string using the fretting data for the second string;

generate a plurality of successive pitch estimates for the second string based on successive values of the first fundamental frequency estimate or the second fundamental frequency estimate; and generate a smoothed pitch estimate for the second string using the plurality of pitch estimates.

15. The device of claim 14, wherein the one or more processors are further configured to determine a power of the second string, and to vary a number of the successive pitch estimates used to generate the smoothed pitch estimate based on the power of the second string.

16. The device of claim 9, wherein the one or more processors are further configured to:

receive string data representing vibrations of the strings of the stringed instrument;

determine a discrete spectrum using a range of the string data for a second string of the stringed instrument;

determine a power spectral density for the range of the string data using the discrete spectrum;

extract a plurality of harmonics from the power spectral density; and identify one of the harmonics as a fundamental frequency estimate for the second string.

* * * * *